US008702501B2

(12) United States Patent
Gadda et al.

(10) Patent No.: US 8,702,501 B2
(45) Date of Patent: Apr. 22, 2014

(54) FORMATION AND USE OF FORMAL PARTNERSHIPS FOR PLAY GAMES

(75) Inventors: Christian E. Gadda, Las Vegas, NV (US); Chauncey W. Griswold, Reno, NV (US); Harold E. Mattice, Gardnerville, NV (US); James W. Stockdale, Clio, CA (US); Richard L. Wilder, Sparks, NV (US)

(73) Assignee: IGT, Las Vegas, NV (US)

( * ) Notice: Subject to any disclaimer, the term of this patent is extended or adjusted under 35 U.S.C. 154(b) by 1646 days.

(21) Appl. No.: 11/697,224

(22) Filed: Apr. 5, 2007

(65) Prior Publication Data

US 2008/0248844 A1 Oct. 9, 2008

(51) Int. Cl.
*A63F 9/24* (2006.01)

(52) U.S. Cl.
USPC ..... 463/29

(58) Field of Classification Search
USPC ..... 463/16–20, 25–28, 42
See application file for complete search history.

(56) References Cited

U.S. PATENT DOCUMENTS

| | | | | |
|---|---|---|---|---|
| 5,605,506 | A | 2/1997 | Hoorn et al. | |
| 6,142,872 | A * | 11/2000 | Walker et al. | 463/16 |
| 6,206,782 | B1 | 3/2001 | Walker et al. | |
| 6,217,448 | B1 | 4/2001 | Olsen | |
| 6,361,441 | B1 * | 3/2002 | Walker et al. | 463/42 |
| 6,488,585 | B1 | 12/2002 | Wells et al. | |
| 6,503,146 | B2 | 1/2003 | Walker et al. | |
| 6,656,048 | B2 | 12/2003 | Olsen | |
| 6,712,699 | B2 | 3/2004 | Walker et al. | |
| 6,869,361 | B2 | 3/2005 | Sharpless et al. | |
| 7,070,505 | B2 | 7/2006 | Vancura et al. | |
| 7,081,050 | B2 | 7/2006 | Tarantino | |
| 7,169,041 | B2 | 1/2007 | Tessmer et al. | |
| 7,291,067 | B2 | 11/2007 | Tarantino | |
| 7,311,598 | B2 | 12/2007 | Kaminkow et al. | |
| 7,311,604 | B2 | 12/2007 | Kaminkow et al. | |
| 7,322,887 | B2 | 1/2008 | Belger et al. | |
| 7,351,140 | B2 | 4/2008 | Wolf et al. | |
| 7,364,510 | B2 | 4/2008 | Walker et al. | |
| 7,393,280 | B2 | 7/2008 | Cannon | |
| 7,427,236 | B2 | 9/2008 | Kaminkow et al. | |
| 7,448,949 | B2 | 11/2008 | Kaminkow et al. | |

(Continued)

FOREIGN PATENT DOCUMENTS

| | | |
|---|---|---|
| WO | WO2006/084290 | 8/2006 |
| WO | WO2006/093732 | 9/2006 |

OTHER PUBLICATIONS

International Search Report dated Nov. 5, 2008 issued in PCT/US2008/058490.

*Primary Examiner* — Steve Rowland
(74) *Attorney, Agent, or Firm* — Neal, Gerber & Eisenberg LLP

(57) ABSTRACT

Techniques for forming and using formal partnerships are disclosed. Two or more entities (e.g., individual players, groups, organizations) can form a partnership for the purpose of participating in one or more games. In effect, a game can be played for a partnership without the active participation of all the entities (or partners) that have formed the partnership. The game can, for example, be played by one or the partners or an authorized representative of the partnership. When a game is played on behalf of a partnership, the gaming activity is effectively tracked and verification data is stored for the partnership. Verification data can be made available to allow the partners to verify the outcome of the game.

29 Claims, 16 Drawing Sheets

(56) References Cited

U.S. PATENT DOCUMENTS

| | | | | |
|---|---|---|---|---|
| 7,500,915 | B2 | 3/2009 | Wolf et al. | |
| 7,597,621 | B2 | 10/2009 | Baerlocher | |
| 7,607,976 | B2 | 10/2009 | Baerlocher et al. | |
| 7,607,977 | B2 | 10/2009 | Baerlocher et al. | |
| 7,621,809 | B2 | 11/2009 | Baerlocher et al. | |
| 7,637,811 | B2 | 12/2009 | Walker et al. | |
| 7,651,392 | B2 | 1/2010 | Pennington et al. | |
| 7,654,896 | B2 | 2/2010 | Baerlocher | |
| 7,666,081 | B2 | 2/2010 | Baerlocher et al. | |
| 7,666,092 | B2 | 2/2010 | Kaminkow et al. | |
| 7,690,977 | B2 | 4/2010 | Cuddy et al. | |
| 7,713,120 | B2 | 5/2010 | Cannon | |
| 7,713,124 | B2 | 5/2010 | Cuddy et al. | |
| 7,722,464 | B2 | 5/2010 | Cuddy et al. | |
| 7,753,782 | B2 | 7/2010 | Cuddy et al. | |
| 7,753,783 | B2 | 7/2010 | Cuddy et al. | |
| 7,753,784 | B2 | 7/2010 | Baerlocher | |
| 7,771,270 | B2 | 8/2010 | Kaminkow et al. | |
| 7,789,755 | B2 | 9/2010 | Davis et al. | |
| 7,819,745 | B2 | 10/2010 | Cuddy et al. | |
| 7,828,649 | B2 | 11/2010 | Cuddy et al. | |
| 7,854,654 | B2 | 12/2010 | Baerlocher et al. | |
| 7,857,699 | B2 | 12/2010 | Baerlocher | |
| 7,892,093 | B2 | 2/2011 | Kniesteadt et al. | |
| 7,896,734 | B2 | 3/2011 | Kaminkow et al. | |
| 7,963,847 | B2 | 6/2011 | Baerlocher | |
| 7,993,195 | B2 | 8/2011 | Belger et al. | |
| 8,021,230 | B2 | 9/2011 | Baerlocher et al. | |
| 2002/0010025 | A1 | 1/2002 | Kelly et al. | |
| 2002/0111209 | A1* | 8/2002 | Walker et al. | 463/25 |
| 2002/0151365 | A1 | 10/2002 | Walker et al. | |
| 2002/0173355 | A1* | 11/2002 | Walker et al. | 463/25 |
| 2003/0236110 | A1* | 12/2003 | Beaulieu et al. | 463/1 |
| 2004/0204235 | A1 | 10/2004 | Walker et al. | |
| 2004/0242297 | A1* | 12/2004 | Walker et al. | 463/13 |
| 2004/0242303 | A1 | 12/2004 | Walker et al. | |
| 2006/0035708 | A1* | 2/2006 | Nguyen et al. | 463/29 |
| 2006/0240892 | A1 | 10/2006 | Walker et al. | |
| 2006/0247013 | A1 | 11/2006 | Walker et al. | |
| 2006/0247014 | A1 | 11/2006 | Walker et al. | |
| 2007/0010322 | A1* | 1/2007 | Walker et al. | 463/25 |
| 2007/0054732 | A1 | 3/2007 | Baerlocher | |
| 2007/0087823 | A1* | 4/2007 | Walker et al. | 463/25 |
| 2007/0093288 | A1* | 4/2007 | Walker et al. | 463/25 |
| 2007/0093298 | A1* | 4/2007 | Brunet | 463/42 |
| 2007/0123341 | A1 | 5/2007 | Tessmer et al. | |
| 2007/0167217 | A1 | 7/2007 | Kaminkow et al. | |
| 2007/0173323 | A1* | 7/2007 | Johnson et al. | 463/42 |
| 2008/0020847 | A1 | 1/2008 | Kniesteadt et al. | |
| 2008/0070676 | A1 | 3/2008 | Baerlocher et al. | |
| 2008/0070677 | A1 | 3/2008 | Baerlocher et al. | |
| 2008/0070678 | A1 | 3/2008 | Baerlocher et al. | |
| 2008/0070702 | A1 | 3/2008 | Kaminkow et al. | |
| 2008/0081690 | A1 | 4/2008 | Baerlocher et al. | |
| 2008/0081691 | A1 | 4/2008 | Baerlocher et al. | |
| 2008/0102916 | A1* | 5/2008 | Kovacs et al. | 463/16 |
| 2008/0113765 | A1 | 5/2008 | DeWaal | |
| 2008/0113771 | A1 | 5/2008 | Baerlocher et al. | |
| 2008/0139290 | A1 | 6/2008 | Kniesteadt et al. | |
| 2008/0176650 | A1 | 7/2008 | Wolf et al. | |
| 2008/0311980 | A1 | 12/2008 | Cannon | |
| 2010/0197379 | A1 | 8/2010 | Cannon | |
| 2010/0210348 | A1 | 8/2010 | Peterson | |
| 2010/0291991 | A1 | 11/2010 | Baerlocher et al. | |

* cited by examiner

FORMATION AND USE OF FORMAL PARTNERSHIPS FOR PLAY GAMES

BACKGROUND OF THE INVENTION

Typically, a gaming machine utilizes a master controller to effectively control various combinations of devices that allow a player to play a game on the gaming machine and also encourage game play on the gaming machine. A game played on a gaming machine usually requires a player to input money or indicia of credit into the gaming machine, indicate a wager amount, and initiate playing a game of chance. These steps require the gaming machine to control input devices, such as bill validators and coin acceptors, to accept money into the gaming machine and recognize user inputs from devices, including key pads, button pads, card readers, and ticket readers, to determine the wager amount, and initiate game play. After game play has been initiated, the gaming machine determines the outcome of the game, presents the game outcome to the player and may dispense an award of some type depending on the outcome of the game. The operations described above may be carried out on the gaming machine when the gaming machine is operating as a "stand alone" unit and/or linked in a network of some type to a group of gaming machines.

As technology in the gaming industry progresses, more and more gaming services are being provided to gaming machines via communication networks that link groups of gaming machines to a remote computer, such as a host server, that provides one or more gaming services. As an example, gaming services that may be provided by a remote computer to a gaming machine via a communication network of some type include player tracking, accounting, cashless award ticketing, lottery, progressive games, and bonus games or prizes. These services and features are provided in addition to the games that are available for play on the gaming machines.

In a progressive system, a plurality of gaming machines can be linked together. A percentage of game play on each gaming machine can then be used to determine a progressive jackpot value. The progressive jackpot value is typically determined by a central server in communication with each of the linked gaming machines. The central server updates the progressive jackpot value as it receives information regarding game play on the linked gaming machines and broadcasts this progressive jackpot value to the linked gaming machines.

The progressive jackpot value usually begins at a pre-defined value and continually increases until a win or a hit occurs at one of the linked gaming machines in the progressive system. After a win, the progressive jackpot is paid out at the machine showing the hit jackpot and the system resets to the pre-defined value and begins incrementing again. This procedure then repeats as jackpots are won and game play continues.

One type of progressive system links gaming machines spread out over many locations, such as gaming machines in stores, casinos and airports distributed throughout the state of Nevada. This type of system is typically referred to as a "wide area progressive" (WAP) system and a jackpot on this type of system is referred to as a wide area progressive (WAP) jackpot. A WAP system can link thousands of gaming machines and the WAP jackpot can reach values that are in the hundreds of thousands of dollars or millions of dollars. A number of different WAP systems are existence today just in the state of Nevada.

Progressive systems have proven to be popular with players of gaming machines and currently serve as one of the major attractions to gaming establishments. As such, it is highly desirable to provide a much wider access to progressive games and other major attractions currently provided by gaming establishments. More generally, improved techniques for allowing wider access to games would be highly useful.

SUMMARY OF THE INVENTION

Broadly speaking, the invention relates to techniques for forming and using formal partnerships of two or more entities (e.g., individual players, groups, organizations) for the purpose of playing one or more games on behalf of the partnership. It will be appreciated that the partnership allows a game to be played effectively for the partnership without the active participation of all the entities (or partners) that have formed the partnership. As a result, it would be easier to participate in various games. By way of example, a single person can actively play a game (e.g., a poker game, slot or reel game) on behalf of a partnership of two or more players without requiring the presence of the other partners. The person who actively participates can, for example, be one of the partners and/or a representative authorized to play the game on behalf of the partnership.

It will be appreciated that a formal and/or documented partnership can be formed in accordance with one embodiment of the invention. In one embodiment, Partnership Data (PD) representing a partnership is generated and stored for a partnership of two or more entities. The Partnership Data (PD) can, for example, include rules that effectively define the partnership, information pertaining to the individual entities, as well as accounting information and distribution rules. Typically, a Partnership Identifier (PID) is generated. The PID can effectively identify a particular partnership in a gaming environment. The PID and/or another identifier can also serve as a user-identifier provided to the entities that have formed the partnership. The PID and/or another identifier can, for example, be displayed, printed and/or encoded in various instruments (e.g., player-tracking cards, tickets, vouchers, coupons). The PID can, for example, be provided as a name, number, symbol, password and/or security code, and/or encoded as such in various instruments. By way of example, a person can access a website to effectively register a partnership and subsequently receive a password for accessing the partnership account and a player tracking card that can be used by anyone of the partners to play a game in one or more gaming establishments.

In accordance with another aspect of the invention, the game played on behalf of the partnership is effectively tracked and/or documented at least to the extent that the outcome of the game can be subsequently verified. In one embodiment, Verification Data (VD) is generated to allow subsequent verification of the outcome of a game played on behalf of the partnership. Typically, the Verification Data (VD) is generated based on the outcome of the game and stored for the partnership. Typically, the Verification Data (VD) is stored for a Partnership Identifier (PID).

In accordance with yet another aspect of the invention, an entity can be effectively provided with information regarding a partnership that has been formed for the purpose of playing one or more games in a gaming environment. Typically, the information is provided to an entity authorized to receive the information. The information can, for example, include the status of partnership and/or partnership accounts, the status and/or outcome of any games played on behalf of the partnership. In one embodiment, Verification Data (VD) is provided in response to a valid request form an entity entitled and/or authorized to verify the outcome of one or more games played on behalf of a partnership. By way of example, a partner and/or authorized representative can access a website to view the outcome of one or more games played on behalf of the partnership. As another, an instrument can be inserted in a gaming machine to view the outcome of the game(s).

The invention can be implemented in numerous ways, including a method, an apparatus, a computer readable medium, a computing device, or a signal embodied in a carrier wave. Several embodiments of the invention are discussed below.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

Figure 1A:
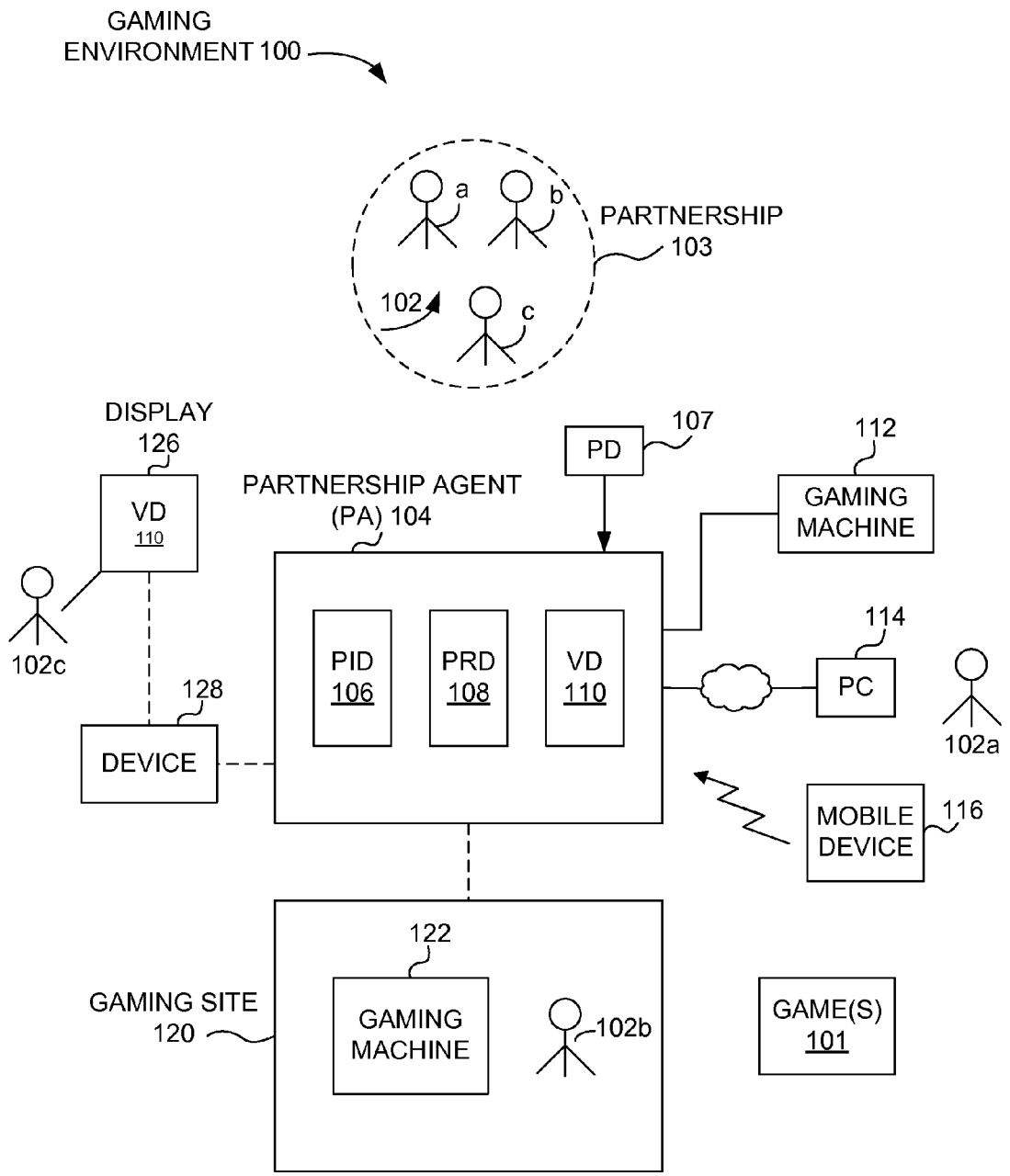
FIG. 1A depicts a gaming environment in accordance with one embodiment of the invention.

As noted in the background section, improved techniques for allowing wider access to gaming environments would be highly useful. The invention pertains to techniques for forming and using formal partnerships of two or more entities (e.g., individual players, groups, organizations) for the purpose of playing one or more games on behalf of the partnership. It will be appreciated that the partnership allows a game to be played effectively for the partnership without the active participation of all the entities (or partners) that have formed the partnership. As a result, it would be easier to participate in various games. By way of example, a single person can actively play a game (e.g., a poker game, slot or reel game) on behalf of a partnership of two or more players without requiring the presence of the other partners. The person who actively participates can, for example, be one of the partners and/or a representative authorized to play the game on behalf of the partnership.

It will be appreciated that a formal and/or documented partnership can be formed in accordance with one embodiment of the invention. In one embodiment, Partnership Data (PD) representing a partnership is generated and stored for a partnership of two or more entities. The Partnership Data (PD) can, for example, include rules that effectively define the partnership, information pertaining to the individual entities, as well as accounting information and distribution rules. Typically, a Partnership Identifier (PID) is generated. The PID can effectively identify a particular partnership in a gaming environment. The PID and/or another identifier can also serve as a user-identifier provided to the entities that have formed the partnership. The PID and/or another identifier can, for example, be displayed, printed and/or encoded in various instruments (e.g., player-tracking cards, tickets, vouchers, coupons). The PID can, for example, be provided as a name, number, symbol, password and/or security code, and/or encoded as such in various instruments. By way of example, a person can access a website to effectively register a partnership and subsequently receive a password for accessing the partnership account and a player tracking card that can be used by anyone of the partners to play a game in one or more gaming establishments.

In accordance with another aspect of the invention, the game played on behalf of the partnership is effectively tracked and/or documented at least to the extent that the outcome of the game can be subsequently verified. In one embodiment, Verification Data (VD) is generated to allow subsequent verification of the outcome of a game played on behalf of the partnership. Typically, the Verification Data (VD) is generated based on the outcome of the game and stored for the partnership. Typically, the Verification Data (VD) is stored for a Partnership Identifier (PID).

In accordance with yet another aspect of the invention, an entity can be effectively provided with information regarding a partnership that has been formed for the purpose of playing one or more games in a gaming environment. Typically, the information is provided to an entity authorized to receive the information. The information can, for example, include the status of partnership and/or partnership accounts, the status and/or outcome of any games played on behalf of the partnership. In one embodiment, Verification Data (VD) is provided in response to a valid request form an entity entitled and/or authorized to verify the outcome of one or more games played on behalf of a partnership. By way of example, a partner and/or authorized representative can access a website to view the outcome of one or more games played on behalf of the partnership. As another, an instrument can be inserted in a gaming machine to view the outcome of the game(s).

Embodiments of these aspects of the invention are discussed below with reference to FIGS. 1A-8. However, those skilled in the art will readily appreciate that the detailed description given herein with respect to these figures is for explanatory purposes as the invention extends beyond these limited embodiments.

FIG. 1A depicts a gaming environment 100 in accordance with one embodiment of the invention. The gaming environment 100 effectively provides one or more games 101 (e.g., a game of chance) for the entities 102. Typically, a reward (e.g., a monetary prize) can be awarded to the one or more entities (e.g., persons, players) 102 that effectively participate in a game. The games can, for example, be provided by one or more gaming or gambling entities (e.g., casinos). However, the games need not be a game of chance. Furthermore, there is no need for an award or prize to be provided. In general, a game 101 can be any game that results in an outcome. As such, the one or more games 101 can, for example, include a horse race, an arm-wrestling match, a chess match, etc. Given that games of chance played for monetary awards are more prevalent in gaming environments today, the following description provides exemplarily embodiments that more suited for games of chance played for monetary awards.

Referring to FIG. 1A, a partnership agent 104 effectively allows the entities 102 to form a partnership for the purpose of participating in one or more games 101 provided by the gaming environment 100. Although each of the individual entities 102 are represented as individual persons in FIG. 1A, it should be clear that each entity 102 can, for example, represent a team, group of players, a corporate entity, etc. In general, an entity 102 can be an entity that qualifies and desires to form a partnership with one or more other qualified entities that also wish to form a partnership for purpose of participating in one or more games 101 provided by the gaming environment 100. Those skilled in the art will appreciate that the partnership agent 104 can, for example, be provided as computer program code (or software) and/or hardware. By way of example, the partnership agent 104 can be effectively provided as a general purpose gaming server or as a specialized server specifically provided for facilitating the formation and/or use of partnerships in the gaming environment 100.

In any case, in order to effectively form a partnership for the entities 102, the partnership agent 104 generates a Partnership Identifier (PID) 106 that can effectively identify a particular partnership 103 formed for a plurality of the entities 102. More particularly, the Partnership Agent (PA) 104 generates the Partnership Identifier (PID) 106 based on the Partnership Data (PD) 106 associated with the partnership 103. Typically, the Partnership data (PD) 107 is provided by and/or on behalf of the entities 102 seeking to form the partnership 103. Referring to FIG. 1A, one of the entities 102 (102*a*) can, for example, use a gaming machine 112, a Personal Computer (PC) 114 and/or a mobile/wireless device 116 to effectively provide the Partnership Data (PD) 107 to the Partnership Agent (104).

The Partnership Data (PD) 107 can vary widely, for example, based on what is desired and/or acceptable by the governing gaming regulations. As such, Partnership Data (PD) 107 can, for example, specifically identify each of the participants and effectively define various aspect of the partnership agreement including the amount of contribution, distribution of awards, specific game to be played, place and time for playing the games. As such, it will be appreciated that Partnership Data (PD) 107 can be robust enough to allow defining a very complex partnership expected to last for a relatively long period of time similar to a business partnership or other legally recognized partnerships in existence today. On the other hand, the Partnership Data (PD) 107 can, for example, be a simple request to form a partnership to play an unspecified game. Such a request can, for example, be made anonymously subject to subsequent verification of players as required by the governing gaming regulations. By way of example, a partnership can be effectively formed by paying money in person or through a trusted entity that transfers funds on behalf of one or more unknown entities. In such cases, a simple voucher, a special token, a ticket or other instruments can be provided. In any case, the Partnership Agent (PA) 104 can generate a Partnership Identifier (PID) 106 based on the Partnership Data (PD) 107. In addition, the Partnership Agent (PA) 104 can generate Partnership Rules Data (PRD) 108 effectively defining one or more rules for the partnership 103. As suggested above, the Partnership Rules Data (PRD) 108 can define a wide range of partnerships varying from the simple to the very complex.

It will be appreciated that the Partnership Identifier (PID) 106 can be effectively used to track the gaming activities of the partnership 103. The gaming activities include games that can be performed on behalf of the partnership. By way of example, the Identifier (PID) 106 can be directly provided by one the partners (e.g., by entering a code) and/or effectively extracted from a token, voucher, or player tracking card. Referring to FIG. 1A, one of the entities, for example, 102 (102*b*) can engage in gaming activities in a gaming site 120. If the Partnership Identifier (PID) 106 is produced and/or recognized, for example, by the gaming machine 122, the PID 106 is communicated to the Partnership Agent (PA) 104. The PA 104 can retrieve the Partnership Rules Data (PRD) 108 and verify that a game qualifies to be played on behalf of the partnership 103. In addition, the Partnership Agent 104 can effectively track the gaming activities to generate the Verification Data (VD) 110. VD 110 can be effectively used to verify the outcome and/or awards associated with a game played on behalf of the partnership 103.

In other words, the Partnership Agent (PA) 100 can effectively provide the Verification Data (VD) 110 for the partnership 103 identified by the PID 106. The VD 110 can, for example, be used to effectively verify the outcome and/or ward for any number of games played on behalf of the partnership 103. It will be appreciated that the Verification Data (VD) 110 can, for example, be used by any one of the entities 102 that have formed the partnership (partners) to verify the outcome of any game played on behalf of the partnership. Accordingly, the Partnership Agent (PA) 104, among other things, can form the partnership 103, recognize a request and/or attempt to play a game on behalf of the partnership 103, approve the request and/or attempt, effectively track the gaming activities performed on behalf of the partnership 103, generate Verification Data (VD) 110 that effectively stores or records the result of the gaming activities. Partnership Agent (PA) 104 can effectively provide the Verification Data (VD) 110 to the entities 102. Referring to FIG. 1A, Verification Data (VD) data can, for example, be displayed on a display 126 of a device 128 used by one of the entities 102 (102*b*) in order to, for example, allow verification of the result of a game played on behalf of the partnership.

Figure 1B:
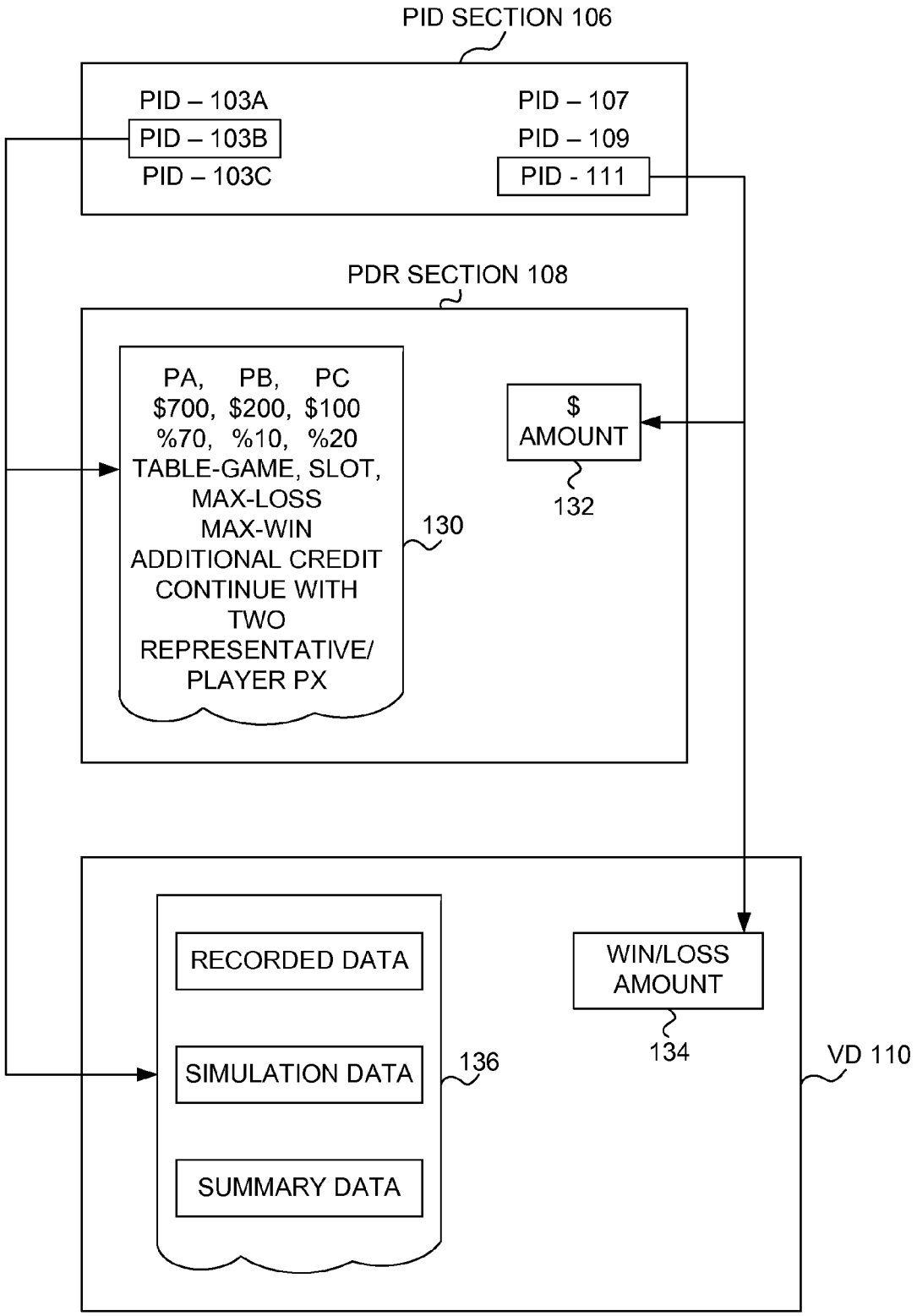
FIG. 1B depicts data that can be stored by the Partnership Agent (PA) in accordance with one embodiment of the invention.

FIG. 1B depicts data that can be stored by the Partnership Agent (PA) 104 in accordance with one embodiment of the invention. Referring to FIG. 1B, the Partnership Identifier (PID) section 106 includes various identifiers corresponding to partnerships effectively formed and/or recognized by, for example, the Partnership Agent (PA) 104 depicted in FIG. 1A. It should be noted that the same entities may form various partnerships with different rules. As such, Partnership Identifiers 103*a*, 103*b* and 103*c* can, for example, represent three (3) different partnerships formed by the same entities. Alternatively, Partnership Identifiers 103*a*, 103*b* and 103*c* can, for example, represent different versions of the same partnership as a particular partnership evolves and/or changes. This would provide a record for future reference. Generally, the Partnership Rules Data (PDR) section 108 store PDR data. PDR data, among other things, can effectively document a partnership. Also, each Partnership Identifier (PID) can effectively refer, point to and/or reference its corresponding Partnership Rules Data (PDR). Referring to FIG. 1B, the PID_103B refers to data 130 that effectively provides the Partnership Rules Data (PRD) for the partnership identified by the PID_103A.

As suggested by the data 130, Partnerships Data (PD) can be relatively complex and provide, for example, the identity of each of the partners, amount of contribution and distribution for each of the partners, games that can or cannot be played, maximum win and/or loss for each person before the partnership is suspended or terminated, additional credit available for each of the partners, whether the partnership should dissolve if one or more partners effectively leave the partnerships, whether new entities can join the partnership and if so under what conditions, and one or more players that can actively participate in a game as a representative on behalf of the partnerships.

It should be noted that one or more persons that have formed a partnership can participate in actively playing a game on behalf a partnership and/or a non-partner may be selected on behalf of the partners as a person authorized to play under certain rules and regulation defined by the PDR and/or the governing rules and regulations. It should also be noted that in contrast to data 130, the Partnership Rules Data (PDR) can be extremely simple. Referring to FIG. 1B, Partnership Rules Data (PDR) 132 can, for example, just define the amount of money of credit available to be played on behalf of a partnership identified by PID-111. Furthermore, the partners may be anonymous and/or not identified by the Partnership Agent (PA) 104 provided the governing rules and regulations allow it. Similar to Partnership Rules Data (PDR) 108, the Verification Data (VD) 110 can vary widely. Referring to FIG. 1B, Verification Data (VD) 134 can, for example, be merely an indication of win or loss and/or the amount won or lost (e.g., $20, −20.10). On the other hand, Verification Data (VD) 136 can provide a host of options to allow verification of data by the partners and/or authorized representatives. These options can, for example, include recorded data that would effectively show the game as it occurred (e.g., live recording of the game as it occurred) simulation data that can effectively simulate the game play as it occurred, and/or a detailed or brief summary of the game results (e.g., time and place the game was played and how much was won or lost).

Figure 1C:
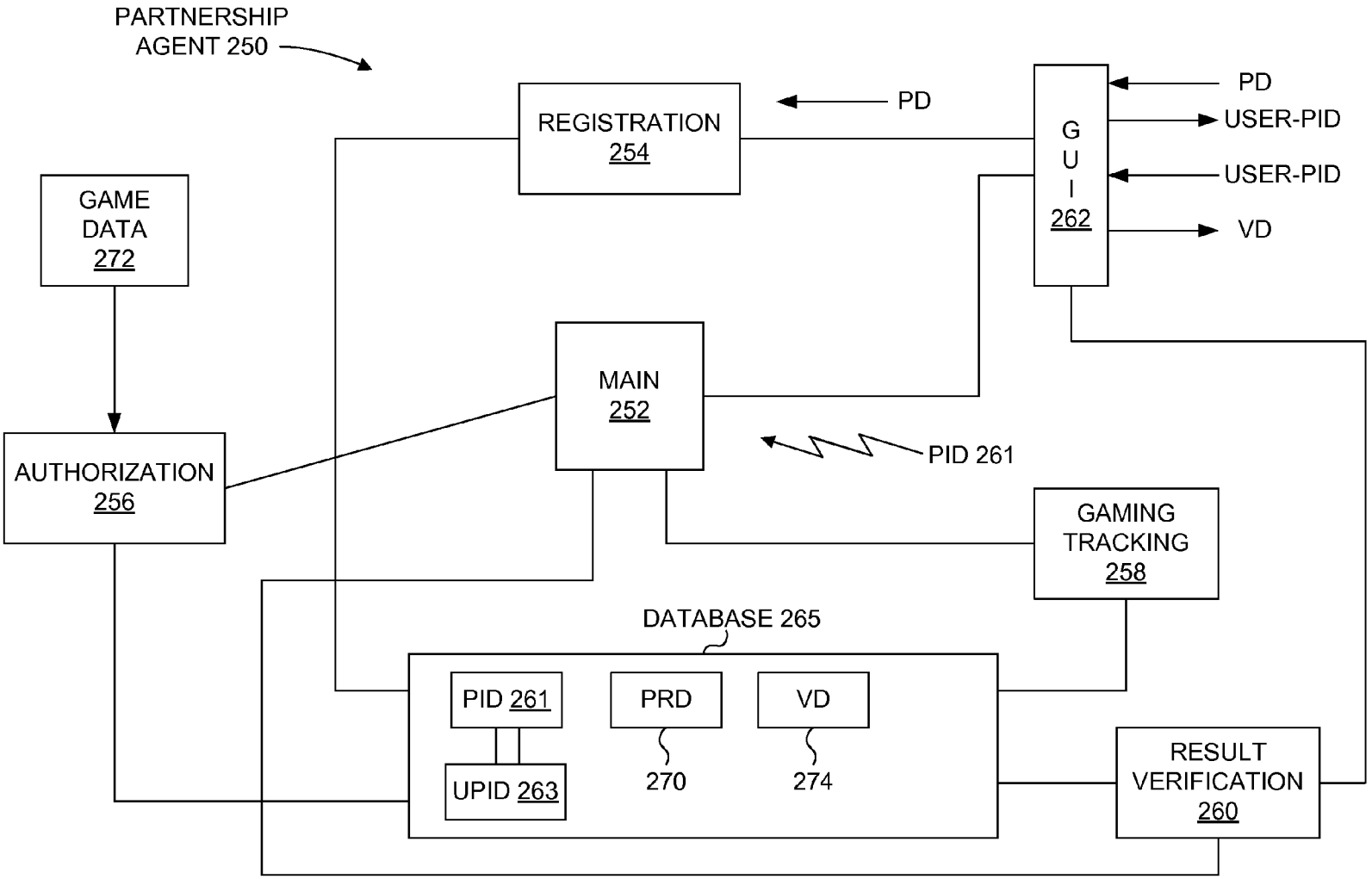
FIG. 1C depicts a Partnership Agent in accordance with another embodiment of the invention.

FIG. 1C depicts a Partnership Agent (PA) 250 in accordance with another embodiment of the invention. Referring to FIG. 1C, a main component (or main module) 252 effectively manages the registration 254, authorization 256, game tracking 258, result verification 260, and Graphical User Interface (GUI) 262 components. Those skilled in the art will appreciate that each of the individual components can be implemented as software and/or hardware. Generally, the Graphical User Interface (GUI) 262 is provided for interaction with a user and, among other things, can be used to provide various menus, forms to facilitate the formation of a partnership. Typically, a person can use the Graphical User Interface (GUI) 262 in order to provide information relating to a partnership. Referring to FIG. 1C, the information relating to the partnership is received as Partnership Data (PD) via the Graphical User Interface (GUI) 262. The Partnership Data (PD) can be provided to the registration component 254 to effectively register or form a partnership with the Partnership Agent 250. The registration component 254 can directly receive the Partnership Data (PD) via the Graphical User Interface (GUI) 262 and/or via the main component 252. In any case, the registration component 254 can generate a Partnership Identification (PID) and Partnership Data Rules (PRD) based on the Partnership Data (PD) provided via the Graphical User Interface (GUI) 262. It should be noted that a User Partnership Identification (UPID) can be provided to the user via GUI 262. The UPID may be the same as the PID used internally by the Partnership Agent (PA) 250 or a corresponding reference that may be more suited for humans (e.g., a name, web address, link, password, security code). It should be noted that various other forms of material can also be effectively provided by the PA 250. These materials include, for example, tickets, vouchers, coupons, player tracking cards, tokens. In this way, the registration component 254 can facilitate registration of a partnership. Referring to FIG. 1C, a PID and a UPID 263 can be stored in a local or remote database 265. The registration phase is summarized in FIG. 1D.

After a partnership has been registered with the Partnership Agent (PA) 250, a partnership play tracking phase can follow when a game played on behalf of the partnership is effectively tracked. Referring back to FIG. 1C, a registered PID 261 can be received and/or identified to indicate a request for partnership play. By way of example, a partnership ticket, voucher, coupon, player tracking card, or token can be inserted into a game machine and/or presented to a dealer. Alternatively, a person may, for example, enter a security code and/or account number into a device that communicates with the Partnership Agent 250 or may provide the information to an operator, administrator and/or dealer who can effectively provide it to the Partnership Agent 250. It should be noted that instead of the PID, a UPID can be effectively presented or provided to the Partnership Agent 250. In such cases, the UPID can be matched to the corresponding PID.

In any case, if the registered PID 261 is received and/or identified by the main component 252, the authorization component 256 is activated. The authorization component 256 can effectively authorize playing a game on behalf of the partnership identified by the registered PID. More particularly, the authorization component 256 can obtain and/or receive the Partnership Rules Data (PRD) 270 corresponding to the partnership identified by the PID 261. In addition, the authorization component 256 can obtain and/or receive the game data 272 relating to the game that can be authorized for partnership play. The game data 272 can, for example, be provided when a game or a request to play a game is initiated. It will be appreciated that the game data 272 can be provided in real time in accordance with one embodiment of the invention. By way of example, game data 272 can be generated and transmitted by a gaming machine that communicates with the Partnership Agent (PA) 250. The gaming machine can, for example, detect a PID when a player-tracking card is inserted. Subsequently, the gaming machine can, on its own or in response to a request from the authorization agent 256 generate and/or transmit the game data 272 relating to a game that is to be authorized for partnership play. The authorization component 256 can authorize the game or deny it at least partly based on the Partnership Rules Data (PRD) 270. If a game and/or instance of game play is authorized for partnership play, the authorization component 256 can directly or via the main component 252 activate the gaming tracking component 258. When activated, the game tracking component 258 effectively tracks a game that has been authorized by the authorization component 256 for partnership play. Game tracking can vary widely. It may be limited to receiving and storing the game result. On the other hand, game tracking can effectively include recording the game play as it happens ("live"), storing data needed to simulate game play as it occurred and/or storing data that can effectively provides a detailed result or brief summary of the result of the game. As such, tracking the game can, for example, record the image of the symbols on a slot machine when a slot game is played on behalf of a partnership, record the person playing the game, store information including the time and place where a particular game was played, amount of the bet which was made, and the result of the game.

Regardless of what game tracking activity is performed, the game tracking component 258 can generate and store verification data 274 representative of the game played on behalf of the partnership. The verification data 274 is effectively stored for the partnership identified by the PID 261. As such, the verification data 274 can be located and provided for verification of the results of the game played on behalf of the partnership identified by the PID 261. Typically, a User Partnership Identifier (UPID) 263 is provided by a person who wishes to verify the results of one or more games played on behalf of a partnership. This person can, for example, be one of the partners or someone authorized by one or more partners to verify the result. By way of example, a person can log in to a web site and enter a UPID 263 or PID 261. Depending on the level of security desired, an authentication process can be performed before authorizing access to the Verification Data (VD) 274.

The VD 274 may be provided to anyone who enters the UPID 263 or PID 261 or an authentication process can be performed by the result verification component 260 in accordance with one embodiment of the invention. The Partnerships Rules Data (PRD) 270 can effectively define access rights to the Verification Data (VD) 274 as well as defining the Verification Data (VD) to be gathered in the first place. If access to the Verification Data (VD) 274 is not denied, the result verification component 260 can effectively provide it via the Graphical User Interface (GUI) 262 for display on a display, thereby allowing an authorized person to verify the result of the game(s) played on behalf of the partnership.

Figure 1D:
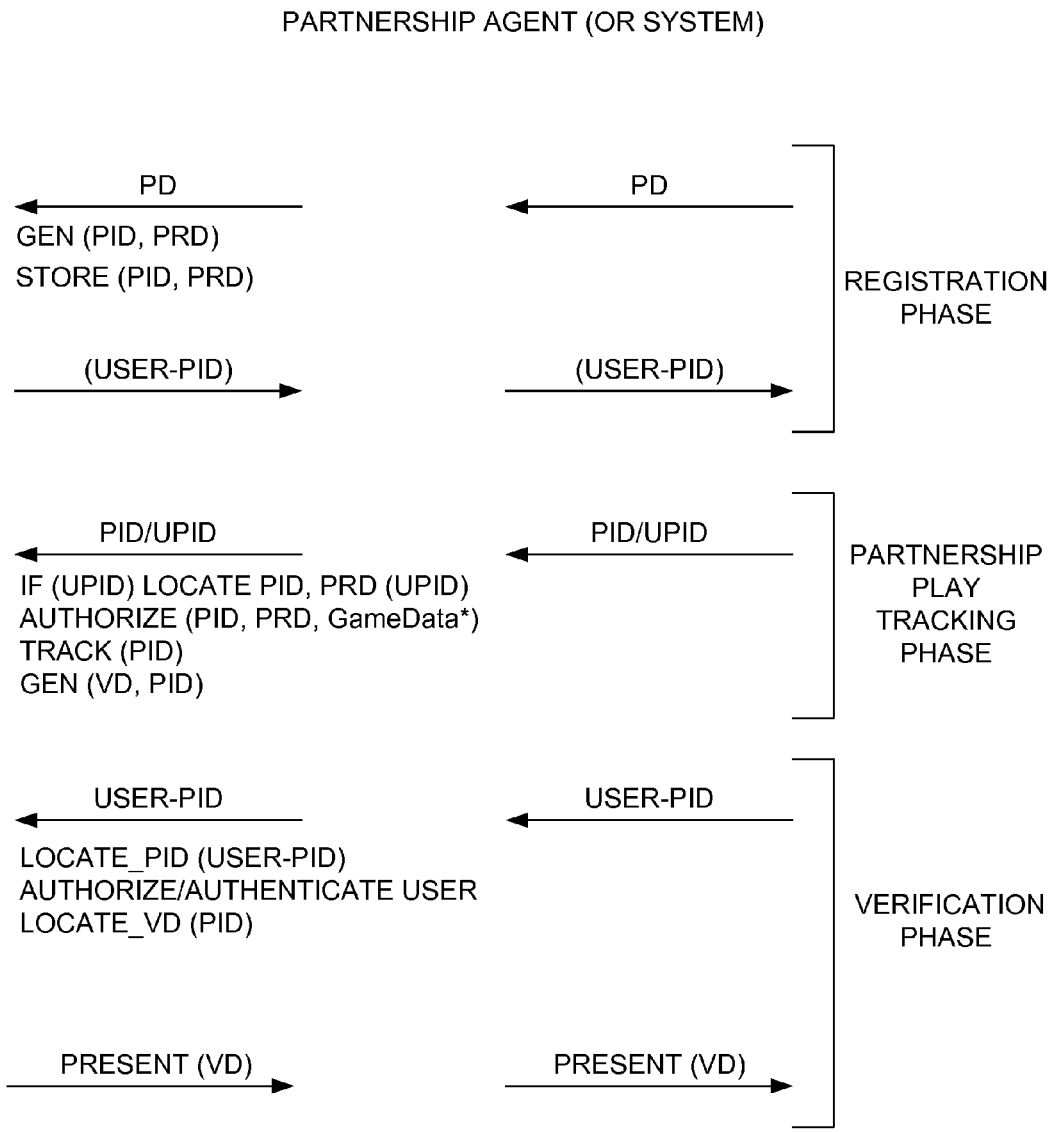
FIG. 1D depicts various conceptual phases of operations associated with the formation and use of a partnership in accordance with one embodiment of the invention.

FIG. 1D depicts various conceptual phases of operations associated with the formation and use of a partnership in accordance with one embodiment of the invention. One or more of the phases of operations can, for example, be performed by a partnership Agent (PA) or system. Referring to FIG. 1D, the first phase of operations is characterized as a registration phase. During the registration phase, data relating to a partnership (Partnership Data) is received and/or identified so that a Partnership Identifier (PID) and Partnership Data Rules (PDR) can be generated and stored for the partnership. In addition, a User Partnership Identifier (PID) may be generated and provided to the one or more entities that are forming the partnership. Referring back to FIG. 1D, the second phase can be characterized as a Partnership play tracking phase which is effectively initiated when a Partnership Identifier (PID) and/or a User Partnership Identifier (UPID) is detected in a connection of a request for playing one or more games on behalf of the partnership. A UPID can be effectively converted to a PID if a different identifier (UPID) is provided to the users. In any case, if there is a need, the corresponding Partnership Rules Data (PRD) can be located based on the Partnership Identifier (PID) and/or a User Partnership Identifier (UPID). Subsequently, a game can be authorized for partnership play based on the Partnership Rules Data (PRD) and/or gaming data relating to the game being authorized for partnership play. The gaming data can be provided in real time and can include data pertaining to a particular instance of the game (e.g., amount of wager, current position of the reels, card being dealt) as well of general information about the game and other general and/or specific information relating to the game and/or gaming environment that provides the game. If the game is authorized for partnership play, gaming activity can be tracked and Verification Data (VD) can be generated and stored for the Partnership Identifier (PID) and/or a User Partnership Identifier (UPID). Referring again to FIG. 1D, a verification phase represents another conceptual phase of operations. Generally, partnership information including gaming activities and/or results are verified during the verification phase. Typically, the verification phase is initiated as a result of a request to verify the activities and/or results of one or more games played on behalf of a partnership. The verification phase can, for example, be initiated when a User Partnership Identifier (UPID) is received and/or identified. An authentication and/or Authentication process may be performed to determine whether to provide Verification Data (VD) to the entity that has made the request for verification of game activity and/or result of game(s) played on behalf of the partnership. Accordingly, the Verification Data (VD) can be located and presented if access is authorized.

It should be noted that Partnership Agent (or system) can be configured to perform many additional operations not depicted in FIG. 1D. These additional operation can, for example, include providing information for verification, update and/or changing the Partnership Rules Data (PRD) before or after a game has been played, providing the current status of accounts and/or funds available for a partnership, facilitating transfer of funds to and from a partnership account, providing automatic notifications of game results and/or status of a partnership via email and/or other forms of electronic communication.

Figure 1E:
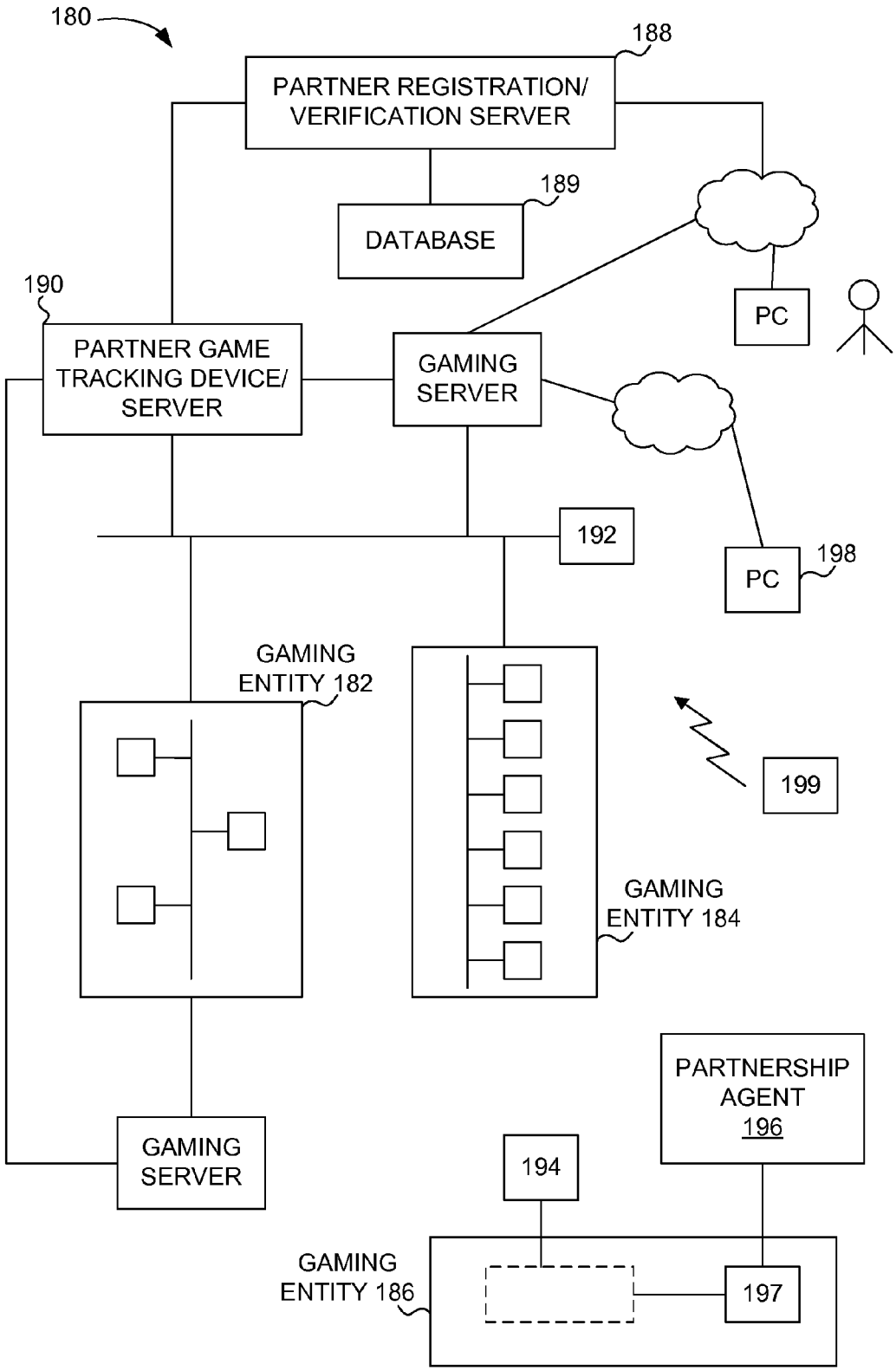
FIG. 1E depicts a gaming environment comprising individual gaming entities (e.g., casinos).

Those skilled in the art will also appreciate that various phases and/or operations of a Partnership Agent (or system) can be distributed and/or combined in many different forms. By way of example, FIG. 1E depicts a gaming environment 180 comprising individual gaming entities (e.g., casinos) 182, 184 and 186. Referring to FIG. 1E, a partner registration and verification server 188 is provided for registering, updating, and verification of partnership information and gaming results. This allows a user to use the same interface, location, and/or site to register and obtain verification information about the games played on behalf of the partnership as well as other activities pertaining to the partnership records stored in the database 189. Referring back to FIG. 1E, partner game tracking devices (or servers) 190, 192 and 194 can be distributed in various locations to detect and track the games played on behalf of a partnership. The partner game tracking devices (or servers) 190, 192 and/or 194 can be in direct, indirect, wired and/or wireless communication with the partner registration and verification server 188 and/or another partner registration and verification server (not shown). Referring again to FIG. 1E, a partnership agent (or system) 196 can effectively perform operations needed to effectively facilitate playing a game on behalf of a partnership. A person can, for example, use a gaming machine 197 to register a partnership with the Partnership Agent (PA) 196. Game results can be verified on the same gaming machine 197 and/or other devices that can communicate with the Partnership Agent (PA) 196. In general, any communication device can be configured for registration and/or verification including Personal Computer (PC) 198, mobile and/or wireless device 199.

Figure 2A:
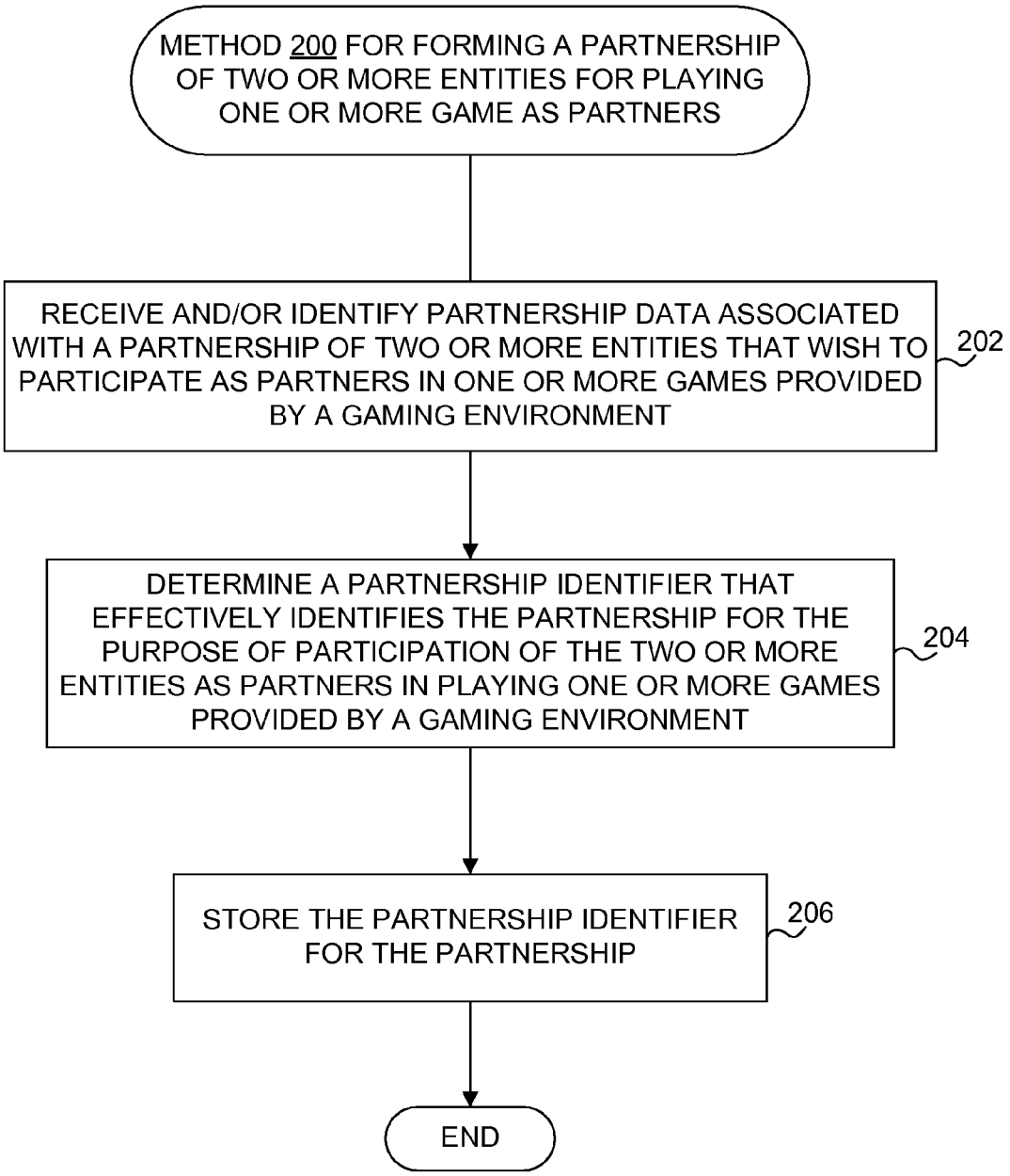
FIG. 2A depicts a method for forming a partnership of two or more entities for playing one or more games as partners in accordance with one embodiment of the invention.
Figure 3A:
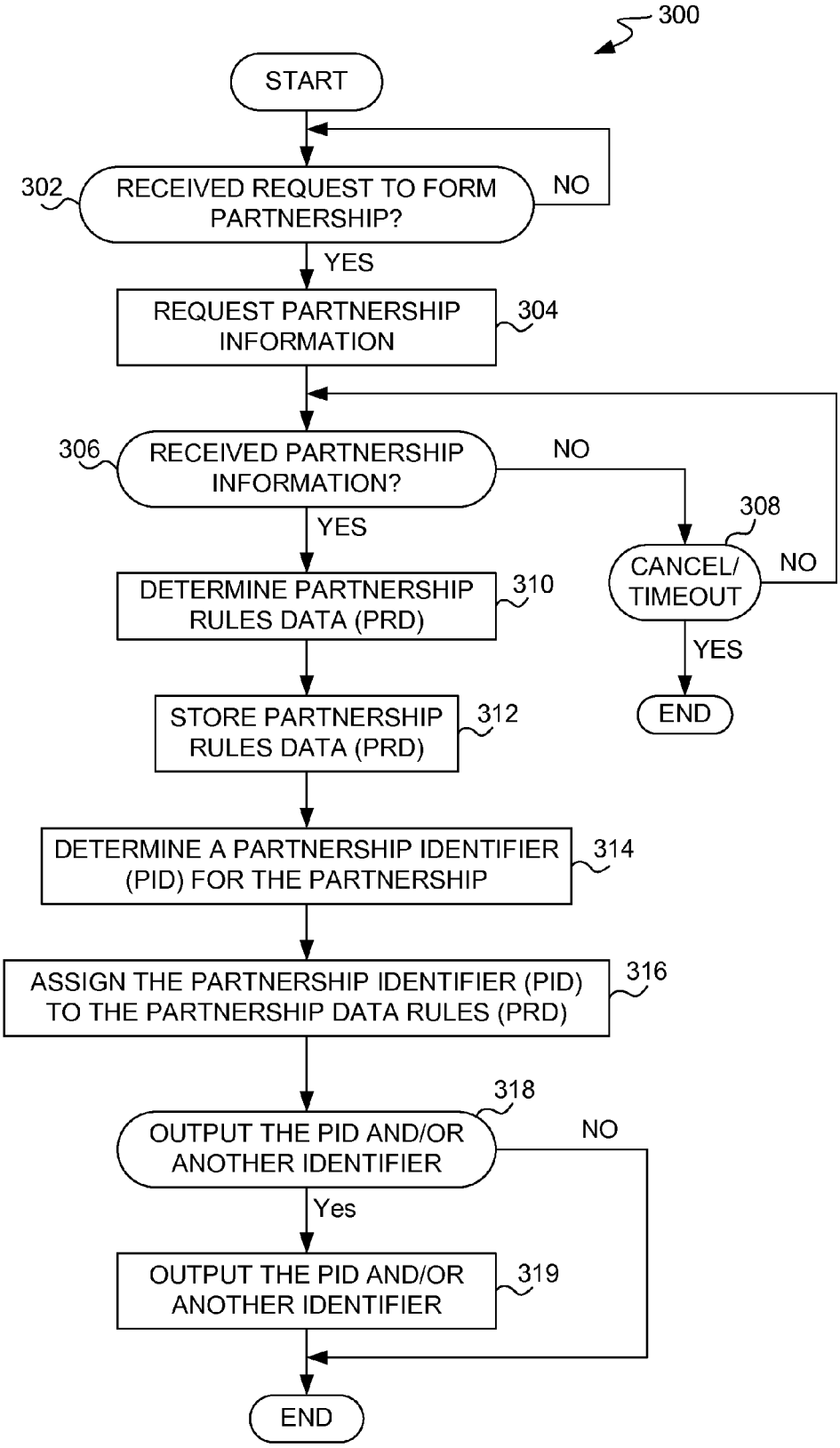
FIG. 3A depicts a method 300 for forming a partnership of two or more entities for the purpose of allowing one or more games to be played on behalf of the partnership in accordance with another embodiment of the invention.

FIG. 2A depicts a method 200 for forming a partnership of two or more entities for playing one or more games as partners in accordance with one embodiment of the invention. The method 200 can, for example, be performed by the Partnership Agent (PA) shown in FIG. 1C. It should be noted that the one or more games are effectively played on behalf of the partnership. The one or more games are provided in a gaming environment where the one or more entities and/or another authorized entity acting as a representative of the partnership can play a game on behalf of the partnership. Initially, Partnership Data (PD) associated with the partnership of two or more entities is received, identified and/or obtained (202). Typically, the entities wish to participate as partners in one or more games provided by a gaming environment. After the Partnership Data (PD) is received, identified and/or obtained (202), a Partnership Identifier (PID) is determined (204). It will be appreciated that the Partnership Identifier (PID) can effectively identify the partnership for the purpose of participation of the two or more entities as partners in one or more games provided by a gaming environment. Accordingly, the Partnership Identifier (PID) is stored (206) for the partnership so that the partnership can be identified. FIG. 3A depicts in greater detail a method 300 for forming a partnership of two or more entities for playing one or more games as partners in accordance with another embodiment of the invention.

Figure 2B:
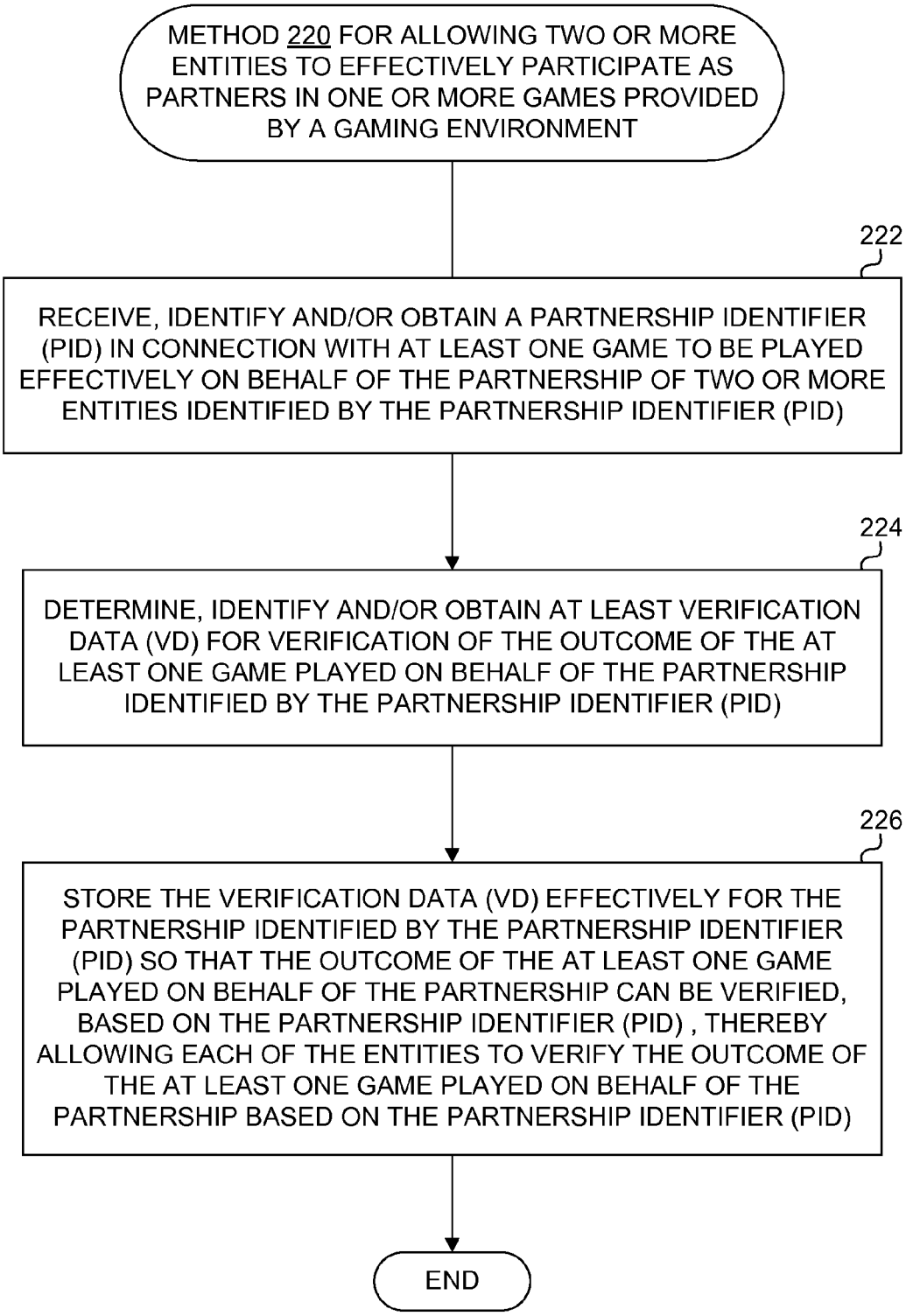
FIG. 2B depicts a method for allowing two or more entities to effectively participate as partners in one or more games provided by a gaming environment in accordance with one embodiment of the invention.
Figure 3B:
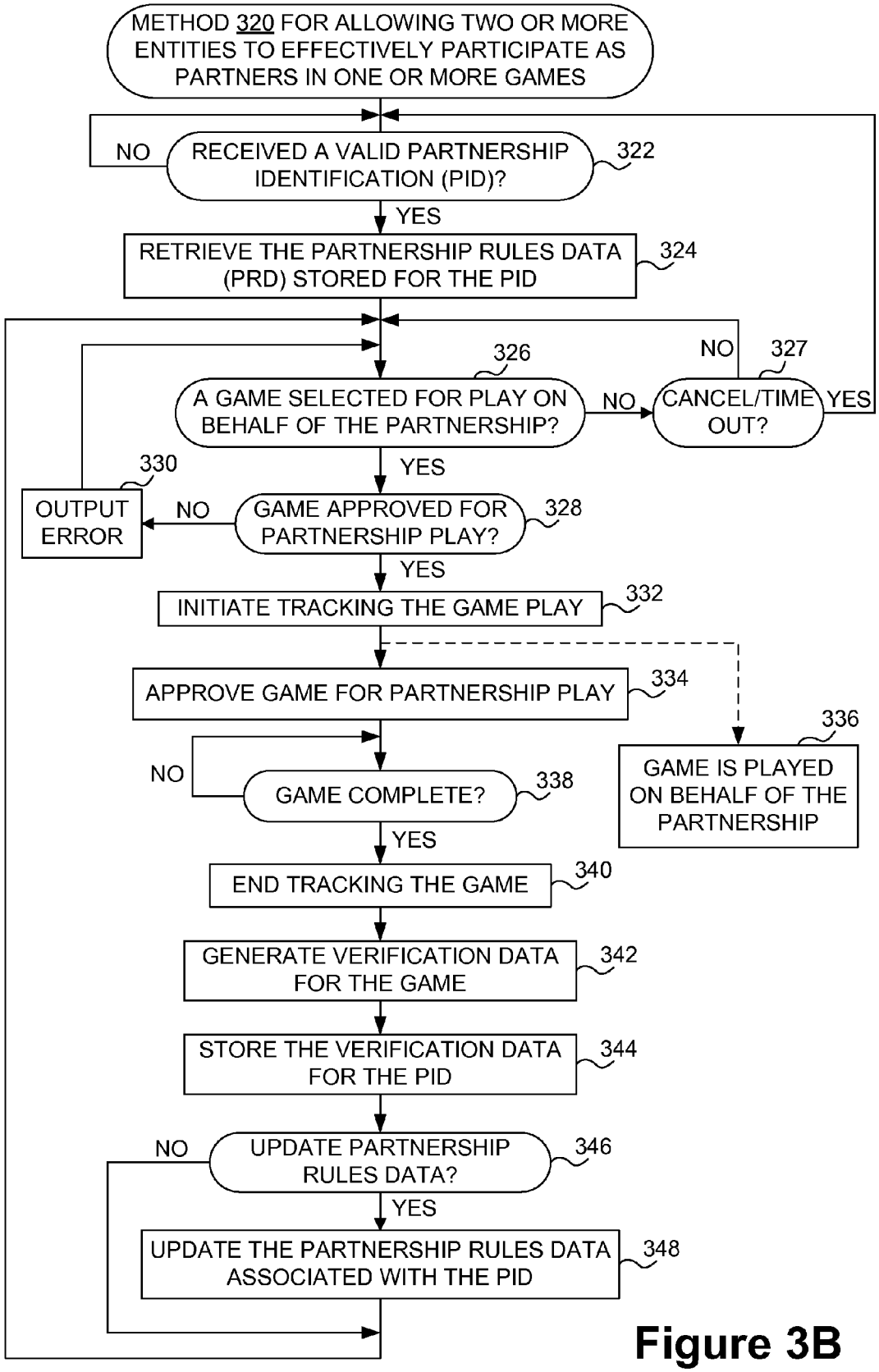
FIG. 3B depicts a method for allowing two or more entities to effectively participate as partners in one or more games provided by a gaming environment in accordance with another embodiment of the invention.

Referring now to FIG. 2B, a method 220 for allowing two or more entities to effectively participate as partners in one or more games provided by a gaming environment is depicted in accordance with one embodiment of the invention. The method 220 can, for example, be performed by the Partnership Agent (PA) shown in FIG. 1C. Initially, a Partnership Identifier (PID) is received, identified and/or obtained (222) in connection with at least one game provided in the gaming environment. It should be noted that one or more games can be played effectively on behalf of the partnership of the two or more entities which can be identified by the Partnership Identifier (PID). Next, Verification Data (VD) for the partnership identified by the Partnership Identifier (PID) is determined, identified and/or obtained (224). It will be appreciated that Verification Data (VD) can be used to effectively verify the outcome of the one or more games played on behalf of the partnership identified by the partnership identifier (PID). Finally, the Verification Data (VD) is effectively stored (226) for the partnership identified by the Partnership Identifier (PID) so that the outcome of the game(s) played on behalf of the partnership can be verified based on the Partnership Identifier (PID), thereby allowing each of the entities that formed the partnership to verify the outcome of the at least one game played on behalf of the partnership based on the Partnership Identifier (PID). FIG. 3B depicts in greater detail a method 320 for allowing two or more entities to effectively participate as partners in one or more games provided by a gaming environment in accordance with another embodiment of the invention.

Figure 2C:
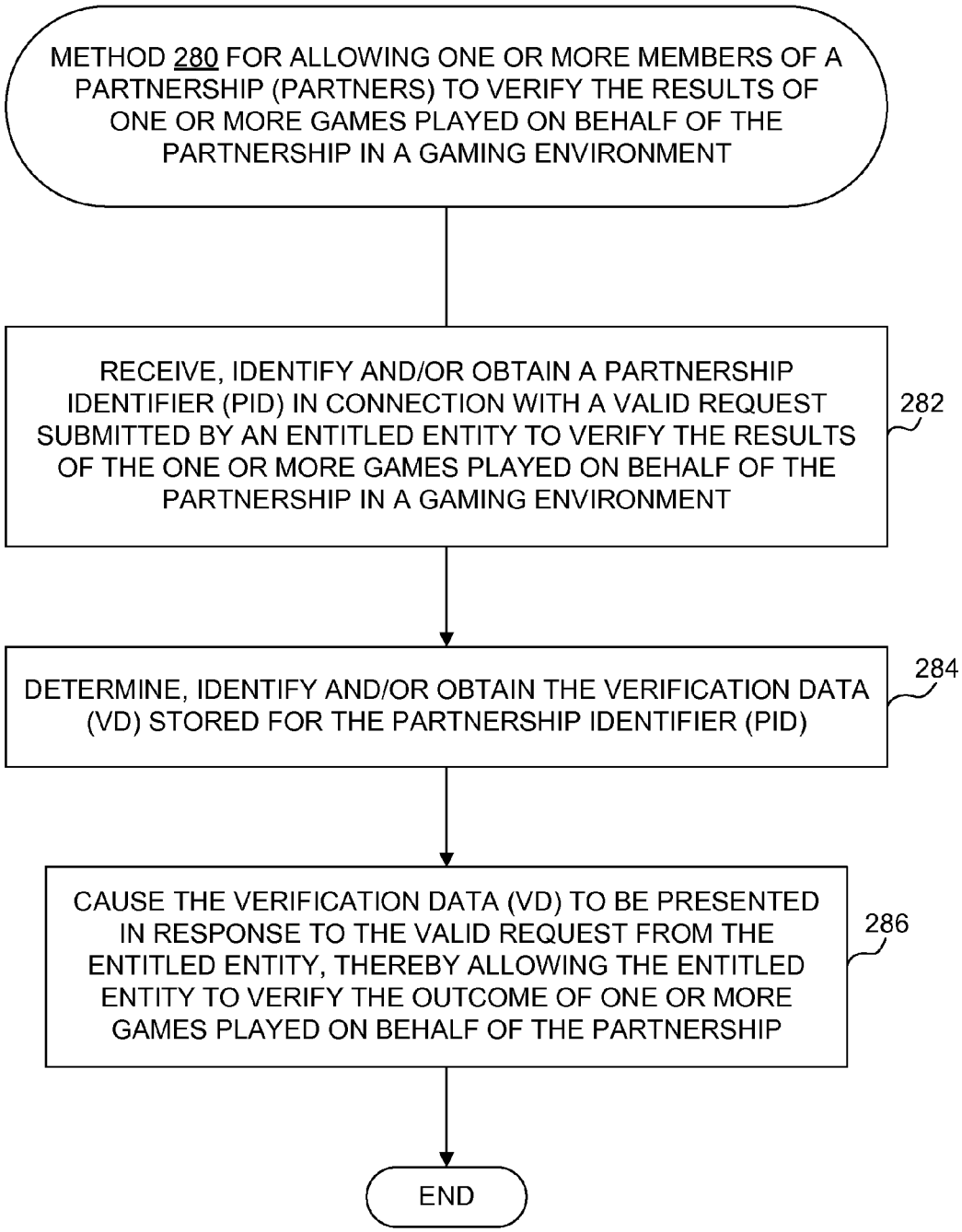
FIG. 2C depicts a method for allowing one or more members of a partnership (partners) to verify the results of one or more games played on behalf of the partnership in a gaming environment in accordance with one embodiment of the invention.
Figure 3C:
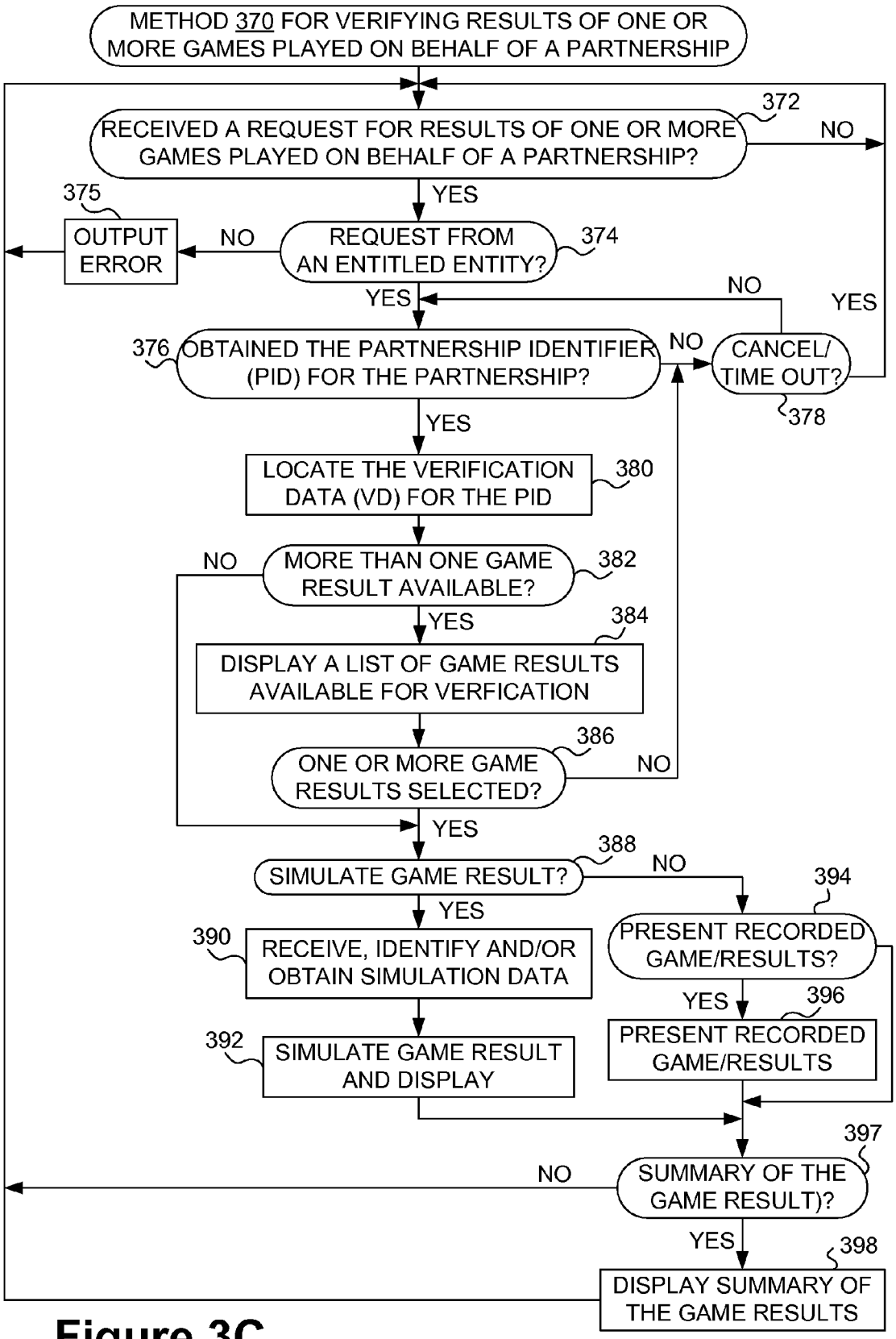
FIG. 3C depicts a method for verifying the results of one or more games played on behalf of a partnership in accordance with one embodiment of the invention.

FIG. 2C depicts a method 280 for allowing one or more members of a partnership (partners) to verify the results of one or more games played on behalf of the partnership in a gaming environment in accordance with one embodiment of the invention. The method 280 can, for example, be performed by the Partnership Agent (PA) 250 shown in FIG. 1C. Initially, a Partnership Identifier (PID) is received, identified and/or obtained (282). Typically, the PID is received in connection with a valid request submitted by an entity (e.g., a person) entitled to verify the results of the one or more games played on behalf of a partnership. The entity can, for example, be one of the partners or an authorized agent or representative of one or more partners. Next, Verification Data (VD) is determined, identified and/or obtained (284). The Verification Data (VD) corresponds to the partnership identified by the PID. Subsequently, the Verification Data (VD) is caused (286) to be presented in response to the valid request from an entitled entity. Verification Data (VD) can, for example, be displayed on a display, transmitted as an email and/or printed on paper. FIG. 3C depicts in greater detail a method 370 for verifying results of one or more games played on behalf of a partnership in accordance with one embodiment of the invention. FIG. 3C is discussed below.

FIG. 3A depicts a method 300 for forming a partnership of two or more entities for the purpose of allowing one or more games to be played on behalf of the partnership in accordance with another embodiment of the invention. Referring to FIG. 3A, initially, it is determined (302) whether a request to form a partnership has been received. It should be noted that a partnership of the two or more entities can be formed for the purpose of playing one or more games on behalf of the partnership. Typically, the one or more games are effectively provided by one or more gaming entities. The request to form the partnership can, for example, be submitted via a website by selecting an option to form a partnership.

If it is determined (302) that a request for forming a partnership has been received, a request (304) for receiving partnership information is effectively made. This request (304) can, for example, be effectively provided by displaying the appropriate form which can be filled in order to form the partnership. Next, it is determined (306) whether the partnership information has been received. In effect, the method 300 can wait to receive the partnership information unless the formation of the partnership is canceled and/or allotted time for providing the partnership information lapses (308). The partnership information needed to form the partnership can vary widely based on many factors including the type of the partnership, preferences of the entities forming the partnership, gaming regulation and/or preferences. In addition, the formation of the partnership may effectively require submission of a fee, signing and/or acknowledging additional documents in accordance with the governing laws and regulations. For simplicity, these additional or optional requirements are not depicted in FIG. 3A, but it will be clear that additional data and/or a fee may be required prior to effective acceptance of the partnership information (i.e., determining (306) that the required partnership information has been received).

In any case, if it is determined (306) that partnership information has been received, partnership rules for the partnership are determined (310) as Partnership Rules Data (PRD). It will be appreciated that the partnership rules can be very simple. As such, it is possible for the partnership rules to consist of, for example, an amount of money or credit that can be used to play any game (e.g., $100 to be played on behalf of the partnership with no further restriction). As such, those skilled in the art sill appreciate that data representing the partnership rules can, for example, be a simple number indicator and/or counter. On the other hand, relatively complex partnerships may require a set of relatively complex rules provided, for example, in a rules database. In any case, after the partnership rules are determined (310), the partnership rules are stored (312) as Partnership Rules Data (PRD). Subsequently, a Partnership Identifier (PID) is determined (314) and assigned (316) to the Partnership Rules Data (PRD) to effectively define the partnership, thereby forming a partnership for the two or more entities. Next, it is determined (318) whether to output the Partnership Identifier (PID) and/or another identifier as a reference that can be provided to the entities that have formed the partnership. Accordingly, the PID and/or another identifier (e.g., a User Partnership Identifier) can be output (319). The PID and/or another identifier can be provided explicitly as a form of a receipt and/or confirmation that is displayed, electrically transmitted, stored and/or printed in a printed form. The PID and/or another identifier can be effectively hidden and/or encoded, for example, in an instrument that encodes the Partnership Identifier (PID) (e.g., a player tracking card, coupon, and/or voucher that securely encodes the PID can be issued).

FIG. 3B depicts a method 320 for allowing two or more entities to effectively participate as partners in one or more games provided by a gaming environment in accordance with another embodiment of the invention. Initially, it is determined (322) whether a valid Partnership Identifier (PID) has been received (322). If it is determined (322) that a valid Partnership Identifier (PID) has been received, the Partnership Rules Data (PRD) associated with the Partnership Identifier (PID) is retrieved (324). It should be noted that the Partnership Rules Data (PRD) associated with a partnership identified by the Partnership Identifier (PID) can be stored for the Partnership Identifier (PID) and effectively retrieved using the Partnership Identifier (PID) as an index. After the Partnership Rules Data (PRD) has been retrieved (324), it is determined (326) whether a game (or an instance of a game play) has been selected for play on behalf of the partnership identified by the Partnership Identifier (PID). In effect, the method 320 can wait until a game is selected for play on behalf of the partnership ("partnership play") or wait to receive a valid Partnership Identification (PID) if a cancellation or timeout it detected (327). If it determined (326) that a game has been selected for play on behalf of the partnership, it determined based on the Partnership Rules Data (PRD) retrieved for the Partnership Identifier (PID) whether the game is approved for partnership play. It will be appreciated that determining (328) of whether a game is approved for partnership play can include several operations. By way of example, it can be determined that the game is consistent with the Partnership Rules Data (PRD), whether sufficient credit has been provided for the partnership to cover the desired wager, and so on. If it determined (328) that the game is not approved for Partnership Play, and error message can be output (330) and the method 320 can effectively wait for another game and/or game instance to be selected for partnership play or wait to receive a valid Partnership Identification (PID) as a result of a timeout or cancellation (327).

If it is determined (328) that the game is approved for partnership play, tracking of the game play is initiated (332) and the game play is effectively approved (334) for partnership play. It should be noted that after the game and/or game instance has been approved (334) for partnership play, the game can be played effectively on behalf of the partnership. It should be noted that the game and/or game instance can be effectively played (336) and/or supervised by the method 320. Alternatively, the game and/or game instance can be played and/or supervised independently of the method 320 by another independent entity (e.g., an independent process and/or program). By way of example, the independent entity would effectively communicate with the method 320 to facilitate tracking the game. As such, the method 320 would effectively determine (338) whether the game and/or game instance has completed. If it is determined (338) that the game has completed, tracking of the game ends (340). Subsequently, Verification Data (VD) is generated (342) for the game and stored (344) for the Partnership Identification (PID). Next, it is determined (346) whether to update the Partnership Rules Data (PRD). It will be appreciated that Partnership Rules Data (PRD) can be updated for various reasons including, for example, updating the amount of credit as a result of a win or loss, changing what games can be played for the partnership, updating the membership of the partnership, and so on. In any case, if it is determined (346) to update the Partnership Rules Data (PRD), the PRD is updated (348). The method 320 can proceed in a similar manner to determine (326) whether another game and/or game instance has been selected to be played on behalf of the partnership and/or determine whether a valid Partnership Identification (PID) has been received as a result of a cancellation and/or time out (327). In effect, the method 320 can proceed to process valid Partnership Identifications (PID) and facilitate playing one or more games and/or particular instances of approved games on behalf of one or more partnerships. Those skilled in the art will also appreciated that the multiple Partnership Identifications can be effectively processed at the same time (e.g., in parallel) to allow concurrent processing of multiple instances of multiple partnerships and/or multiple partnership plays. Further the operations can be performed at different times. For example, PRD can be retrieved (324) after a game is selected (326).

FIG. 3C depicts a method 370 for verifying the results of one or more games played on behalf of a partnership in accordance with one embodiment of the invention. Initially, it is determined (372) whether a request for the results of one or more games is received. Typically, the one or more games are played on behalf of a partnership. If it is determined (372) that a request for the result(s) is received, it is determined (374) whether a request is from an entity who is entitled to receive the results of the one or more games played of behalf of a partnership. If it is determined (374) that the request is not from an entitled entity, an error can be output (375) and the method 370 can effectively wait for another request for the result of one or more games played on behalf of the partnership.

However, if it is determined (374) that the request is from an entitled entity, it is determined (376) whether the Partnership Identifier (PID) for the partnership has been effectively received, identified and/or obtained (376). In effect, the method 370 can wait to receive, identify and/or obtain the PID or wait for another request for the game results when a time out and/or cancellation is detected (378). The Partnership Identifier (PID) and/or a User Partnership Identifier (UPID) can, for example, be entered by a requester and/or read from a card. As another example, The PID and/or UPID can be effectively mapped to a web address, a selectable menu item and/or location.

In any case, if the Partnership Identifier (PID) for the partnership is effectively received, identified and/or obtained (376), the Verification Data (VD) associated with the PID is located (380). Next, it is determined (382) whether more one than one game result is available for the PID. If it is determined (382) that more one than one game result is available for the PID, a list of game results which are available for the partnership identified by the PID is displayed (384). The method 370 effectively waits for one or more game results to be selected for verification unless a time out or cancel an action is detected (378). If it is determined (386) that one or more game results have been selected or it is determined (382) that only one game result is available, it is determined (388) whether to simulate the game and/or game results. This decision (388) can, for example, be made based on a selection made by the user requesting the information and/or based on the type of data that is available. If it is determined (388) to simulate the game and/or game results, simulation data associated with the PID is effectively received, identified and/or obtained (390). The simulation data can, for example, be stored as part of the Verification Data (VD). In any case, the game and/or game result can be simulated and displayed (392) for verification by the entitled entity. On the other hand, if it is determined (388) not to simulate the game or game results, it is determined (394) whether to present recorded game data and/or results. If it is determined (394) to present the recorded game data and/or results, recorded game data and/or results are presented (396). Next, it is determined (397) whether to summarize the game results. It should be noted that after simulating the games and/or game results and/or if it determined (396) not to present the recorded game or game results, it can be determined (397) whether to summarize the game results. If it is determined (397) to summarize the game results, the summary of the game results is displayed (398). After displaying the summary of the game results or if it is determined (397) not to summarize the game results, the method 370 proceeds to determine (372) whether a request for results of one or more games has been received and proceeds in a similar manner as discussed above.

Those skilled in the art will appreciate that the recall of the graphical presentation for game history can, for example, be achieved by retrieving critical game data from the non-volatile memory on the gaming machine and recreating an approximation of the graphical game presentation using a subset of the game code. For each game played on the gaming machine, critical game data stored in non-volatile storage may include the number of credits on the gaming machine when the game was initiated, the wager amount on the game, the paytable used to calculate the game outcome, the game outcome, image positioning information and any other information needed to recreate the visual game history. Often because of storage limitations of the non-volatile memory, a graphical presentation corresponding to the actual game play cannot be identically recreated and only a few specially selected visual portions of the game presentation are regenerated.

Partnership data, among other things, can effectively defines one or more of the following: one or more types of games to be played on behalf of a partnership, one or more types of games to be played on behalf of a partnership, one or more gaming entities or establishments where one or more games are authorized to be played on behalf of a partnership, one or more gaming entities or establishments where one or more games are not authorized to be played on behalf of a partnership, amount of funds and/or credit available for play on behalf of a partnership, information regarding one or more entities, personal information regarding two or more of individuals that have formed or about to form a partnership, amount of individual contribution of the two or more entities, amount of individual distribution to the two or more entities, rules regarding termination of a partnership, rules regarding allowing entities to join a partnership, and one or more players that can play at least one game on behalf of a partnership.

Broadly speaking one or more entities can, for example, include one or more of the following: one or more persons, a group of persons, one or more organizations, a group of organizations, one or more players, and a group of players.

It should be noted various instruments can be issued for a partnership. These instruments can, for example, include an instrument the encodes a partnership identifier and/or another identifier that effectively identifies the partnership, issuing an instrument that prints the partnership identifier and/or another identifier that effectively identifies said partnership, issuing a player tracking card. In addition, other operations can be performed. These operations, for example, include: updating a player tracking card, issuing a coupon and/or voucher, updating a coupon and/or voucher, issuing and/or updating a card and/or ticket, displaying a partnership identifier and/or another identifier; and electronically transmitting a partnership identifier and/or another identifier.

Those skilled in the art will appreciate that various techniques can be used to authenticate and authorize one or more entities before access to partnership information is granted. In addition, content, outcome, one or more screens and/or frames displayed for one or more games can be recorded and/or stored as one or more games are played on behalf of a partnership.

Figure 4:
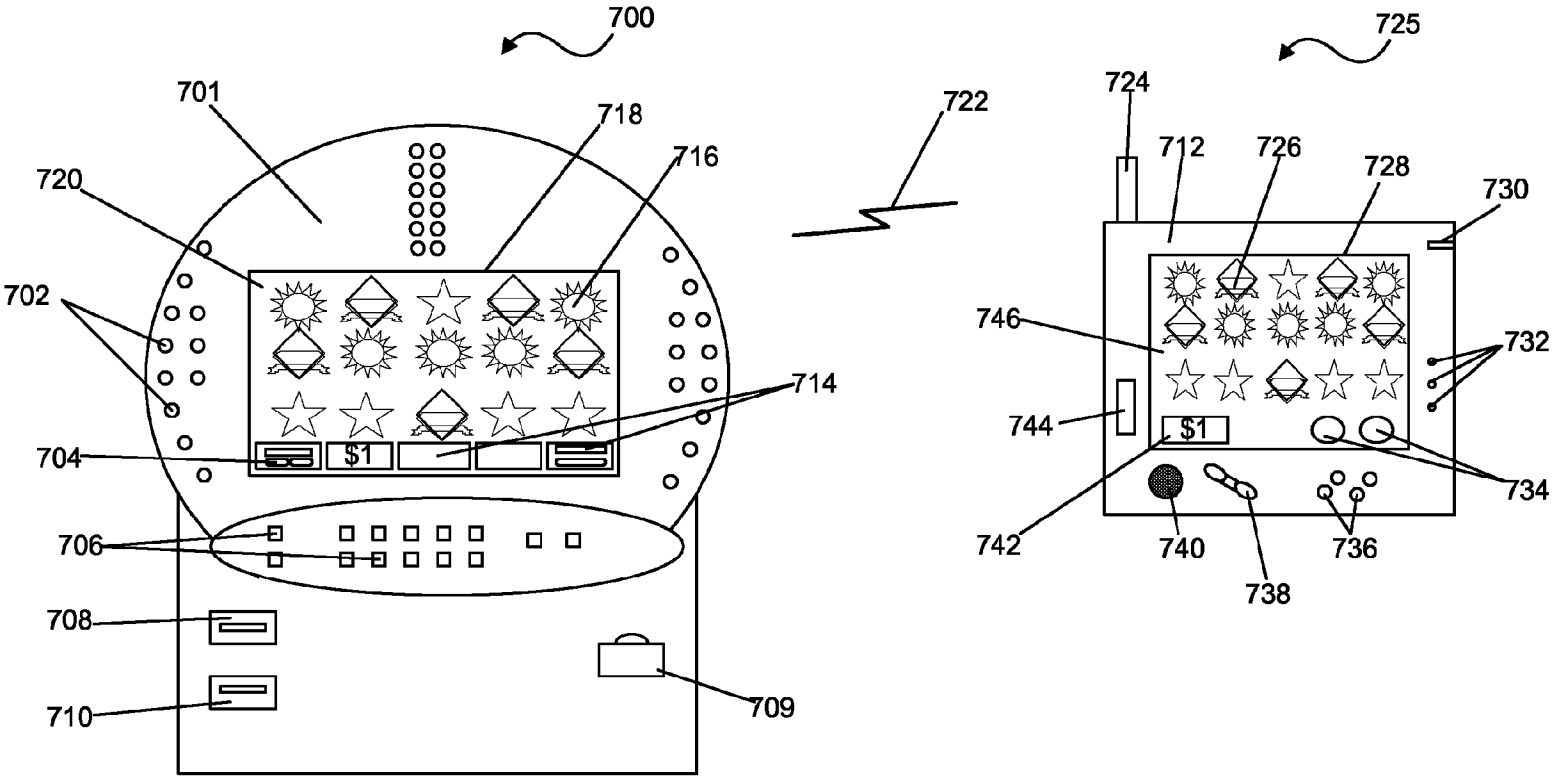
FIG. 4 is block diagram of a gaming machine in communication with a wireless game player.

It should be noted that a wireless gaming device can be used to play a game in a gaming environment that uses the authentication techniques of the invention. FIG. 4 is block diagram of a gaming machine 700 in communication with a wireless game player 725. The wireless game player 725 is used as a remote extension to extend the game playing capabilities of gaming machine 700. Game outcomes for games of chance generated using licensed and regulated gaming software executed on the gaming machine 700 may be presented on the wireless game player 725 at remote locations from the gaming machine 700. Thus, a game generated on a gaming machine 700 may be presented on a display 718 located on the main cabinet 701 of the gaming machine and played using input mechanisms located on the main cabinet of the gaming machine. In addition, the game generated on the gaming machine may be presented on a display 728 located on a wireless game player in communication with the gaming machine and played with input mechanisms located on the wireless game player.

As an example, a game 716 may be presented on a display 718 located on gaming machine 700. The game 716 may be played using input mechanisms, such as input buttons 706 or touch screen interface buttons 704. The touch screen interface buttons 704 are activated using a touch screen 720 located over the display 718 of the gaming machine 700. Further, a game 726 may be presented on display 728 located on the wireless game player 725. The game 726 may be played using input mechanisms located on the wireless game player 725, such as 738 and 736 or touch screen interface buttons 734. The touch screen interface buttons 734 are activated using the touch screen 746 located over the display 728.

The game logic for a game presented on display 718 or display 728 is stored within the main cabinet 701 of the gaming machine 700. The game logic, which is typically regulated gaming software, is executed by a master gaming controller located within the main cabinet 701 of the gaming machine 700. A particular game executed by the master gaming controller may be presented on display 718 or, when the wireless game player 725 is activated, on display 728. When the same game is presented on display 718 or on display 728, the graphical presentations of the game may vary between the displays because of hardware differences. For instance, display 718 may by larger than display 728 allowing for higher resolution graphical output on display 718 as compared to display 728.

While playing a game 726 on the portable wireless game player 725, a player may move throughout the areas of a casino where wireless game play is enabled. For instance, a player may be able to play the game 726 with the wireless game player 725 in a restaurant, a keno parlor or a sports book. The player's position does not have to remain static while playing the game 726 on the wireless game player 725 and the player may be actively moving while games are played on the wireless game player 725.

When a game is played on the wireless game player of the present invention, such as 725, all random number generation (RNG) events, game outcomes, meter information, game related information, and all cash transactions are generated and maintained in the licensed (controlled) gaming machine (e.g. 700), and not the wireless game device. Thus, the wireless game player 725 may be considered a remote extension of the gaming machine's 700 display and input mechanisms. With a gaming machine with a remote extension, the gaming machine may operate in both a local mode and a remote mode. In the local operational mode, game play is presented using the display and input mechanisms located on the gaming machine. In the remote operational model, game play is presented using the display and input mechanisms located on the wireless game player. These two operational modes are described as follows.

During local game play on a gaming machine, a player may input money or indicia of credit into the gaming machine, indicate a wager amount, and initiate a game play. For example, to play the slot game 716 on gaming machine 700, a player may deposit money or indicia of credit using the bill validator 708, the card reader 710 or the coin acceptor 709. Status information 714 for the game, such as a game denomination and available credits may be displayed on display 718. Next, using input buttons 706 and touch screen interface buttons 704, the player may make a wager and initiate the game. The gaming machine determines a game outcome and then presents the game outcome to player on the display 718. For instance, after a slot game has been initiated, the video gaming machine calculates the final position of the reels (e.g. the game outcome), the reels on display 718 spin and then stop at pre-determined position. Based on the pre-determined outcome calculated by the master gaming controller, an award may be presented to the player. As another example, after a card game has been initiated, the video gaming machine 700 calculates a sequence of cards to be dealt to the player and card hands are dealt on the display 718. During the card game play, the player may use input mechanisms on the gaming machine 700 to hold or discard cards. After the card game is complete, an award may be presented to the game player.

The games presented on the gaming machine 700 may be enhanced by additional features. Light patterns, such as from lights 702, and sounds may be generated on the gaming machine 700 to enhance the game outcome presentation. In addition, during certain game events, a bonus game may be presented to the game player.

During remote game play on a gaming machine using a wireless game player such as 725, a player may input money or indicia of credit into the gaming machine, activate a wireless game player, indicate a wager amount on the wireless game player and initiate a game play on the wireless game player. For example, to play the slot game 726 on gaming machine 700 using the wireless game player 725, a wireless game play session is requested by the player. A wireless game play session may include one or more game plays on a wireless game player 725 connected to the gaming machine 700 via a wireless communication link 722. The wireless game play session request by the player may be made using an input mechanisms located on the gaming machine.

Prior to beginning, the wireless game play session, a player may be required to deposit money or indicia of credit to in the gaming machine in communication with the wireless game player. The deposited credits may be used during the wireless game play session. For instance, using the bill validator 708, the card reader 710 or the coin acceptor 709 located on the gaming machine 700, the player may provide an initial amount of credits to be used for a wireless game play session using the wireless game player 725. During game play on the wireless game player, a player wagers a certain amount of credits per game. Depending on the outcome of a particular game, the number of credits available for game play may be decreased or may be increased.

After a game player has used all of their credits during a wireless game play session and the player desires to continue the wireless game play session, the player may be required to return to the gaming machine to add additional credits. In other embodiments (See FIG. 6), a card reader or other input device may be attached to the wireless game player 725 and used to add credits to the gaming machine 700. For instance, a player may be able to enter a credit card number or debit card number and transfer funds to the gaming machine to be used as game credits via a touch screen interface on the wireless game player 725. Further, the wireless game player may include a card reader for scanning a magnetic strip on the debit card or credit card.

After establishing game credits on the gaming machine, the wireless game player 725 is activated. In some embodiments, authentication and verification of the user of the wireless game player is performed. For example, to enforce age restrictions imposed by a jurisdiction, the user may be verified and authenticated to use the game player. The wireless game player may have a biometric sensor (not shown) such as a fingerprint sensor. As part of the authentication process, the player may be asked to place their finger on the sensor located on located on the wireless game player. The fingerprint image is sent back to the controller in the machine for comparison. As another example, the wireless game player may include a smart-card reader that reads biometric smart cards (cards having a built-in fingerprint sensor). The smart card has all the personal information of the casino guest. Thus, the authentication could occur directly at the wireless game player. A description of a finger print reader as an identification device is provided in U.S. Pat. No. 6,488,585, which is incorporated herein in its entirety and for all purposes. Other types of verification methods such as a PIN number or a password may be used separately or in combination with biometric identification methods. Other biometric identification methods that may be used with the present invention include but are not limited to feature identification using a camera, retinal pattern identification using a retinal scanner, voice pattern identification input using a microphone and hand-writing recognition using a hand writing input pad.

For security, the wireless game player has an encrypted serial number (code), which is used to verify and authenticate the wireless game player. For additional security, an electronic key may be used with the device. With an electronic key system, the wireless game player device cannot be activated until the key is inserted into a receptacle on the game player. In addition, the wireless game player may have a small GPS (Global Positioning System) device to verify location of the device. Position verification may be used to insure the wireless game player is used only in legal gaming areas of the casino and to track lost or stolen devices. When the gaming machine detects that the wireless game player is in a restricted area, it may discontinue communications with the wireless game player. Further, the wireless game player may have an RF capacitive device built into the wireless game player. RF capacitive devices are often used in retail stores to prevent theft. When the wireless game player is passed through a protected doorway, an alarm may be sounded even when the power is off to the wireless game player. Other security features may be used on the wireless game player and are not limited to electronic keys, GPS sensors or RF capacitive devices described above. Verification and authentication may be required to start every wireless game play session. Further, there may be a non-play time limit. Once this time is exceeded, a verification and authentication cycle or process must be performed. The verification and authentication cycle may be performed for the player and the wireless game player, for only the player or for only the wireless game player. As another example, authentication and verification may be required after a certain number of games played on the gaming device or may be even be required at random intervals. When verification and authentication requirements are not satisfied during a wireless game play session, the game play session will typically be terminated.

In one embodiment, after the wireless game player is activated 725, the input mechanisms, such as the touch screen 720 and the input buttons 706, built into the gaming machine 700 are deactivated and a wireless game play session may begin. The display 718 on the gaming machine 701 may display an "out of order" message, an "operator" message or the display 718 may be blank to indicate the gaming machine is unavailable for game play. During remote game play on the wireless game player 725, gaming information necessary to present the game on the wireless game player, such as a graphical presentation of game outcome and meter information, is generated on the gaming machine 700 are transmitted to the wireless game player via wireless communication 722. The mathematical methods used to generate the game outcomes remain on the gaming machine 700. Further, gaming information required by the gaming machine 700 to the determine the game outcome, such as signals from input mechanisms located on the wireless game player, are transmitted from the wireless game player 725 to the gaming machine 700 via wireless communication 722.

During game play on the wireless game player 725, status information 742 for the game 726, such as a game denomination and available credits may be displayed on display 728. The status information 742 and the game 726 displayed on the wireless game player 725 may appear similar to what is displayed on the gaming machine 701 but is not necessarily identical to what is displayed on the gaming machine 700. Next, using input buttons, such 734, 736 and 738, the player may make a wager and initiate the game. In one embodiment of the present invention, the touch screen interface buttons 734 may be based on a web-browser interface.

After a game has been initiated on the wireless game player 725, via antenna 724, a wireless communication 722 containing the wager and initiate game inputs is sent to the gaming machine 700. In response, to the wager and the initialization of a game, the gaming machine 700 generates a game outcome including an award and possibly a bonus game. Instructions for displaying the game outcome and bonus game are sent in one or more wireless communications 722 to the wireless game player 725. The one or more wireless communications may be a series of information packets. The format of the information packets will vary according to the wireless communication standard used. Details of a wireless network for providing wireless communications is described with respect to FIG. 7. To illustrate the play of a particular game, a slot game and a card game are described. However, the present invention is not limited to these games as nearly any type of game that can be played on a video gaming machine may also be played on the wireless game player 725. When a slot game 726 has been initiated on the wireless game player 725, the gaming machine 700 calculates the final position of the reels (e.g., the game outcome). The gaming machine may send instruction to the wireless game player to spin the reels on display 728 spin and then stop the reels at a pre-determined position. Based on the final position of the reels calculated by the master gaming controller located on gaming machine 700, an award may be presented to the player. In addition, during certain game events, a bonus game may be presented to the game player as part of the slot game. As another example, after a card game has been initiated on the wireless game player 725, the video gaming machine 700 calculates a sequence of cards to be dealt. The gaming machine 700 sends wireless communications 722 to the wireless game player 725 indicating card hands to be dealt on the display 728. During the card game play, the player may use input mechanisms on the wireless game player 725 to hold or discard cards. After the card game is complete, an award may be presented to the game player. A bonus game may also be incorporated into the card game.

When a customer does not wish to use the wireless game player 725 anymore, the customer can terminate the wireless game play session using the touch screen 746 and deactivate the wireless game player 725. As described above, the wireless game player 725 may automatically terminate a wireless game play session and deactivate itself after a period of inactivity. After roaming with the wireless game player 725, the customer may return to the gaming machine providing the wireless game play session and wish to resume play on the main display of the gaming machine. In this case, the customer may depress a "return" button on the wireless game player 725 and after a verification cycle the player can begin playing at the gaming machine again.

The games presented on the wireless game player 725 may be enhanced by additional features. For instance, light patterns and sounds from the audio output 740 may be generated to enhance the game outcome presentation and add excitement to the games played on the wireless game player 725. Further, the wireless game player may include an audio output interface for connecting headphones. As part of a game outcome presentation, sounds may be transmitted through the audio output interface to headphones worn by the game player.

Details of the wireless game player hardware are now described. The wireless game player 725 is generally a hand-held device. It consists of a housing 712, display 728, touch screen 746, switch panel 744, battery, wireless communication interface, and controller. In one embodiment of the present invention, a modified DT Research WebDT pad (DT Research, Inc., Milpitas, Calif.) is used as a wireless game player. However, the present invention is not limited to the DT research WebDT pad as other hand-held wireless devices such as personal digital assistants (PDA) may also be used.

In one embodiment, the wireless game player may be approximately 10.5×9.5×1.0 inches in size, weigh 3 pounds and use a 10.4 inch color LCD touch screen display. Typically, an 8 inch to 10.4 inch display provides a sufficient viewing area without reducing the size of the character fonts to a point where they are unreadable by most players. The touch screen (sensor) 746 is overlaid on the displayable surface of the LCD 728. Other display technologies can be used instead of LCD, plus some display technologies will incorporate a built-in touch screen (internal vs. external). To activate the touch screen 746, a stylus 730 may be used, but most people will use their fingers.

Audio is available via the small built-in speaker 740 or an external headset. Lighting schemes, such as arrays of LEDs, may be added to the wireless game player 725 to provide visual effects and to communicate status information to a game player. Status information, such as a battery level and connection status, may be provided by the status lights 732. The layout and number of the input buttons, including 738 and 736, is variable. In FIG. 4, the configuration of the input buttons on the gaming machine 700 and wireless game player are different. In one embodiment of the present invention, the input buttons on the wireless game player 725 may be configured in a manner similar to input buttons located on the gaming machine. Further, other devices on the wireless game player, such as the audio output 740, the status lights 732, the antenna 724 and the on/off switch 744 may be located at other locations on the housing 712 depending on the design of the wireless game player.

In one embodiment, the battery will last 5 hours between charging. Charging of the wireless game player may be accomplished by setting the wireless game player in a special storage cradle. The cradles may be in the form of storage bins located in a special area, located at the gaming machine or built as holders located on a desk, counter or table. For instance, a storage cradle for charging the wireless game player may be located in a keno parlor, restaurant tables or sports book. When the wireless game player is placed in a storage cradle it may used while being charged.

The wireless game player 725 can, for example, use an IEEE 802.11b compliant wireless interface. It is a 2.4 Ghz Direct Sequence Spread Spectrum radio system. It has a range of up to 330 ft (inside) from any access point. The data rate is 11 Mbps. IEEE 802.11b is a commonly used radio standard. Other exemplary wireless standards that may be used include IEEE 802.11a, IEEE 802.11×, hyperlan/2, Bluetooth, IrDA, and HomeRF.

In the example above, local gaming and remote gaming on gaming machine 700 has been described in a mutually exclusive manner. Therefore, when local gaming is enabled, remote gaming is disabled and when remote gaming is enabled, local gaming is disabled. However, the present invention is not so limited. Gaming machines that support only remote gaming and not local gaming may be used with the present invention. These gaming machines (see FIG. 6) may be located away from the casino floor. Further, a gaming machine may support simultaneously a plurality of remote gaming devices for game play and not just a single remote gaming device. Finally, gaming machine may be used that simultaneously provide both remote game play and local game play. For instance, one game player may use a gaming machine for local play while another game player is using a wireless game player connected to the gaming machine to play remotely.

Figure 5:
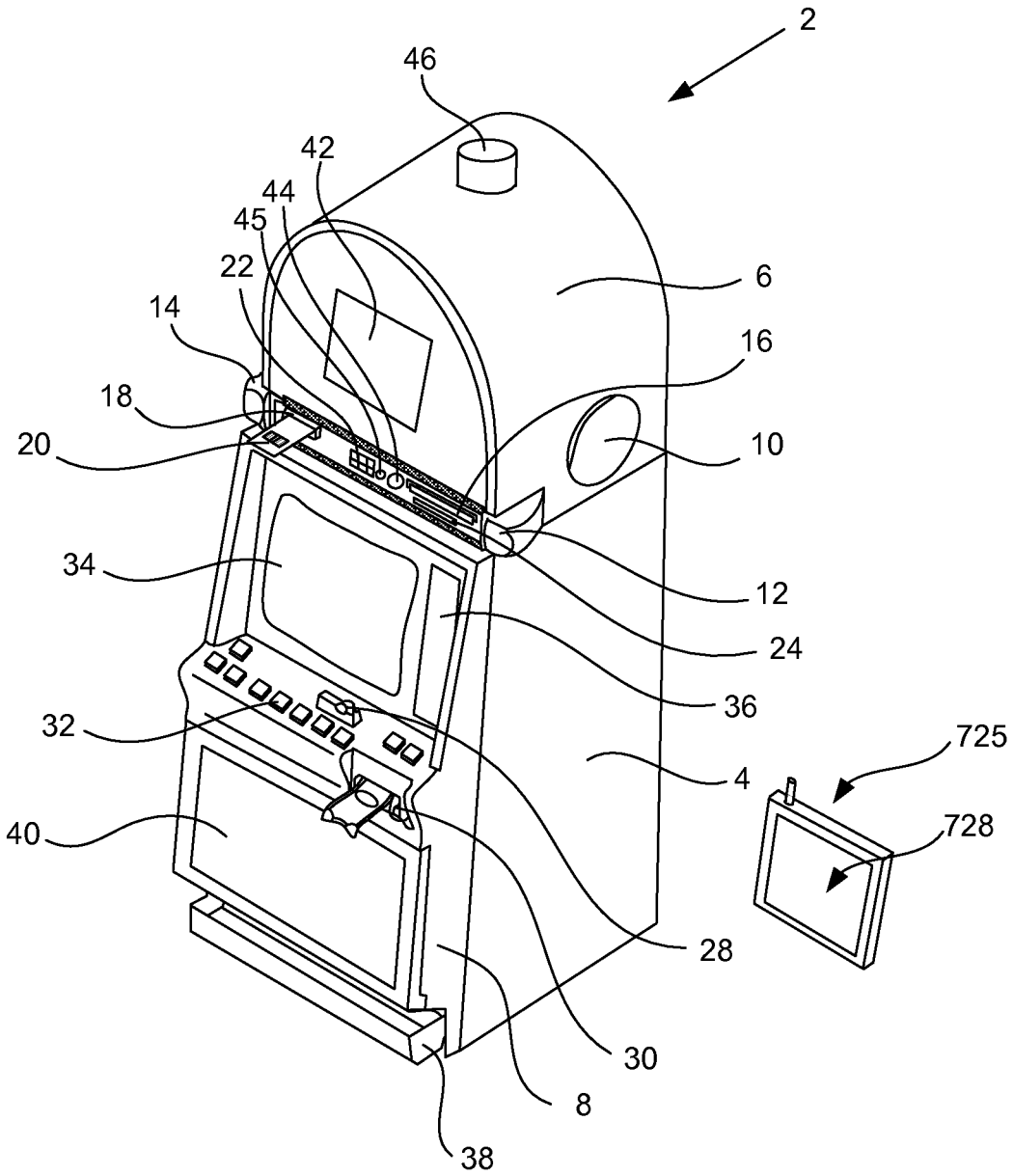
FIG. 5 is a perspective drawing of a gaming machine having a top box and other devices

In FIG. 5, another video gaming machine 2 suitable for use with the present invention is shown. Referring to FIG. 5, more details of a gaming machine as well as additional gaming services that may be provided with a gaming machine providing remote game play sessions are described. For instance, player tracking services may be provided on gaming machines of the present invention and player tracking points may be accumulated during a wireless game play session. Further, using a player tracking device located on a gaming machine, a player may be able to request a wireless game player for use in a wireless game play session.

Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The main display monitor 34 will typically be a cathode ray tube, high resolution flat-panel LCD, or other conventional electronically controlled video monitor. The gaming machine 2 includes a top box 6, which sits on top of the main cabinet 4. A second display monitor 42 may be provided in the top box. The second display monitor may also be a cathode ray tube, high resolution flat-panel LCD or other conventional electronically controlled video monitor. In addition, the gaming machine 2 is designed to communicate to the wireless game player 725 with display 728. The wireless game player 725 effectively provides a remote extension to gaming machine 2.

Figure 6:
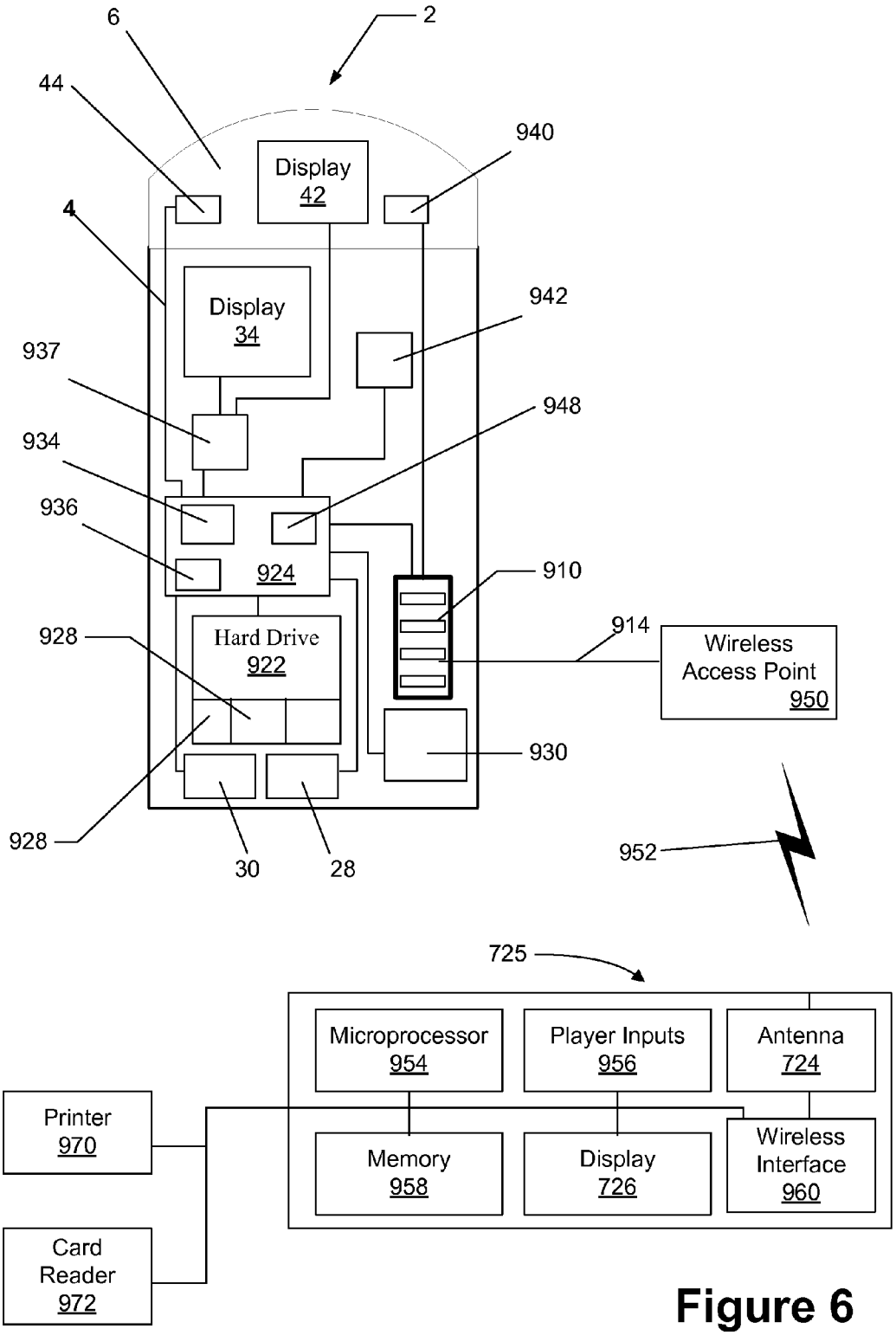
FIG. 6 is a block diagram of the internal components of a gaming machine and internal components of a wireless game player.

Typically, after a player has initiated a game on the gaming machine, one purpose of the main display monitor 34, the second display monitor 42 or the remote display 728 is the visual display of a game outcome presentation, including bonus games, controlled by a master gaming controller 924 (FIG. 6). Also, the main display monitor 34, the second display monitor 42 and the remote display 728 may also be utilized to display entertainment content independent of the game outcome presentation. For example, broadcast events, including television programming, may be provided to the main display monitor 34, the secondary display monitor 42 or the remote display 728. The broadcasts events may be sent to the gaming machine 2 via a cable link or other suitable link from outside of the gaming machine. All or some subset of the programming provided by a television broadcaster may be displayed as entertainment content on one or more of the video displays.

Television programming content of particular interest to casino operators and game players may include, for example, sporting events, talk shows, game shows, soap operas, advertisements, situation comedies, etc. In addition, broadcasts of competitive events on which the player can wager may be displayed. For example, dog racing or horse racing events may be displayed as content on the remote display 728. In such events, typically, there is a rather long down time between races. During this period, the player may play the wireless game player 725 connected to the gaming machine. Also, the television programming entertainment content may be displayed while a player is engaged in playing a game on the wireless game player 725 or between games. Similarly, the entertainment content may include information available on the Internet, including the World Wide Web, for more technologically sophisticated players.

Returning to the gaming machine in FIG. 5, the information panel 36 may be a back-lit, silk screened glass panel with lettering to indicate general game information including, for example, the number of coins played. The bill validator 30, player-input switches 32, video display monitor 34, and information panel are devices used to play a game on the game machine 2 including the wireless game player 725. The devices are controlled by a master gaming controller (see FIG. 6), housed inside the main cabinet 4 of the machine 2. Many possible games, including traditional mechanical slot games, video slot games, video poker, video pachinko, multiple hand poker games, video pai-gow poker, video black jack, video keno, video bingo, video roulette, video craps, video card games and general games of chance, may be provided with gaming machines of this invention. These games may be played using the wireless game player 725.

General games of chance refer to games where a player makes a wager on an outcome of the game. The outcome of the game of chance may be affected by one or more decisions may be the player. For instance, in a video card game, the player may hold or discard cards which affects the outcome of the game.

The top box 6 houses a number of devices, which may be used to add features to a game being played on the gaming machine 2, including speakers 10, 12, 14, a ticket printer 18 which may print bar-coded tickets 20, a key pad 22, a florescent display 16, a camera 45, microphone 44 and a card reader 24 for entering a magnetic striped cards. The speakers may be used to project sound effects as part of a game outcome presentation. The keypad 22, the florescent display 16 and the card reader 24 may be used for to enter and display player tracking information. As another example, the player may enter playing tracking information and identification information using the card reader 24 and the main video display 34 where the main video display may be used as a touch screen to enter information. Player tracking information may be entered into the gaming machine before a player initiates a game on the gaming machine. Typically, the player's incentive to enter player tracking information into the gaming machine 2 is potential rewards related to the amount of a player's game play.

The top box also includes a candle 46. The candle is a light that may be activated by the master gaming controller on the gaming machine. In one embodiment, an antenna (not shown) may be installed in the candle. The antenna may be used to provide wireless game play sessions to one or more wireless game players in communication with the gaming machine 2 via the antenna.

In addition to enabling player tracking services, the key pad 22, the florescent display 16 and the card reader 24 may be used to enter identification information that enables a player to access entertainment content or receive personal messages on the gaming machine independent of a game play and game outcome presentation on the gaming machine 2. For example, a player may enter a personal identification number into the gaming machine 2 using the key pad 22 that allows the player to receive entertainment content such as viewing a movie or a broadcast event. As another example, after entering the personal identification number, the player may be allowed to receive a personal message indicating a table is ready at a restaurant in the casino or to receive a personal message containing information on a sporting event such as a score of personal interest to the player utilizing the gaming machine.

In one embodiment of the present invention, the player tracking services and related gaming service described above may be provided via a touch screen interface on the wireless game player 725. For instance, the wireless game player 725 may include a card reader for reading a player tracking card and player tracking identification information may be provided via a touch screen interface on the wireless game player. Further, the player may be able to access player tracking information using the wireless game player 725.

In addition to the devices described above, the top box 6 may contain different or additional devices than shown in the FIG. 5. For example, the top box may contain a bonus wheel or a back-lit silk screened panel which may be used to add bonus features to the game being played on the gaming machine. During a game, these devices are controlled and powered, in part, by circuitry (not shown) housed within the main cabinet 4 of the machine 2. Understand that gaming machine 2 is but one example from a wide range of gaming machine designs on which the present invention may be implemented. For example, not all suitable gaming machines have top boxes or player tracking features. Further, some gaming machines have two or more game displays—mechanical and/or video, while others are designed for bar tables and have displays that face upwards. As another example, a game may be generated in on a host computer and may be displayed on a remote terminal or a remote computer. The remote computer may be connected to the host computer via a network of some type such as the Internet. Those of skill in the art will understand that the present invention, as described below, can be deployed on most any gaming machine now available or hereafter developed.

Returning to the example of FIG. 5, when a user selects a gaming machine 2, he or she inserts cash through the coin acceptor 28 or bill validator 30. Additionally, the bill validator may accept a printed ticket voucher which may be accepted by the bill validator 30 as an indicia of credit. Once cash has been accepted by the gaming machine, it may be used to play a game on the gaming machine. Typically, the player may use all or part of the cash entered into the gaming machine to make a wager on a game play. Depending on the amount of the wager on a game or for a fee, a player may be able to access various entertainment content sources for a length of time. For example, a wager on a game above a certain threshold amount may enable a player to watch a broadcast event or to access the World Wide Web for up to 5 minutes after each wager on the gaming machine 2. In addition, cash or indicia of credit entered into the gaming machine may be used to purchase entertainment content independent of a wager made on a game on the gaming machine. For example, for a 10 dollar fee, a player may view a movie on the gaming machine. While watching the movie on the gaming machine, the player may play games on the gaming machine 2 or the wireless game player 725 or just watch the movie.

During the course of a game, a player may be required to make a number of decisions which affect the outcome of the game. For example, a player may vary his or her wager, select a prize, or make game-time decisions which affect the game play. These choices may be selected using the player-input switches 32, the main video display screen 34 or using some other device which enables a player to input information into the gaming machine including a key pad, a touch screen, a mouse, a joy stick, a microphone and a track ball.

When a game is not being played on the gaming machine or during particular game operational modes, the player may select an entertainment content source using the above mentioned inputs where the entertainment content is independent of a game being played on the gaming machine. The entertainment content source may include, for instance, a CD player, an FM/AM tuner, a VHS player, a DVD player, a TV tuner, a musical jukebox, a video jukebox, a computer, a server and a media software application. It will be appreciated, however, that any information source may be utilized. Entertainment content from these sources may be selected and displayed on the wireless game player 725. For instance, a player may listen to music from the FM/AM tuner via headphones connected to the wireless game player.

Before playing a game, a player may select the video jukebox, which may contain a DVD player loaded with many DVDs, as the entertainment content source and preview a movie on at least one of the display screens on the gaming machine 2. The DVDs may be stored on the gaming machine 2 or in a central location separate from the gaming machine. The visual display of the output from the video jukebox may be viewed by the player on the main video display screen 34, the secondary video display screen 42 or the remote display 728. The sound for the movie may be projected by the speakers 10, 12 and 14 on the gaming machine or a player may listen to the movie through headphones. As described above, the wireless game player 725 may include an interface for audio output such as a headphone jack.

The game player may also use the player input switches 32, keypad 22, and other input devices to control a feature of the entertainment content. For example, when the entertainment content is a movie, the player input switches 32 and keypad may be operated to fast forward, stop or pause the movie.

When the entertainment content is accessing the World Wide Web through a web-browser, the player input switches 32 and keypad may be used to operate the web-browser. Input switches, as described with respect to FIG. 4, on the wireless game player 725 may also be used to control these functions.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, throbbing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. When a player is using the wireless game player 725, credits available during the wireless game play session are stored on the gaming machine. To redeem credits, for instance to receive a printed ticket voucher, the player may have to return to the gaming machine 700 or a printing station supporting communications with the wireless game player 725. In some embodiments of the present invention, a player may be able to electronically transfer credits to a remote account accessible by the player.

FIG. 6 is a block diagram of the internal components of a gaming machine 2 and a wireless game player 725. Components that appear in FIGS. 4 and 5 are identified by common reference numerals. A master gaming controller 924 controls the operation of the various gaming devices and the game presentation on the gaming machine 2. In the present invention, the wireless game player 725 is one of the gaming devices the master gaming controller 924 controls. The master gaming controller 924 may communicate with the wireless game player 725 via a wireless communication link 952. The wireless communication link may use a wireless communication standard such as but not limited to IEEE 802.11a, IEEE 802.11b, IEEE 802.11x (e.g. another IEEE 802.11 standard such as 802.11c or 802.11e), hyperlan/2, Bluetooth, and HomeRF.

As described above, in the present invention, the gaming machine may operate in a local operational mode where a game is presented on a local display screen, such as 34 or 42, a remote operational mode where a game is presented on the wireless game player 725 or combinations thereof. When the gaming machine 2 is in a local operational mode, using a game code and graphic libraries stored on the gaming machine 2, the master gaming controller 924 generates a game presentation which is presented on the displays 34 and 42. The game presentation is typically a sequence of frames updated at a rate of 60 Hz (60 frames/sec). For instance, for a video slot game, the game presentation may include a sequence of frames of slot reels with a number of symbols in different positions. When the sequence of frames is presented, the slot reels appear to be spinning to a player playing a game on the gaming machine. The final game presentation frames in the sequence of the game presentation frames are the final position of the reels. Based upon the final position of the reels on the video display 34, a player is able to visually determine the outcome of the game.

Each frame in sequence of frames in a game presentation is temporarily stored in a video memory 936 located on the master gaming controller 924 or alternatively on the video controller 937. The gaming machine 2 may also include a video card (not shown) with a separate memory and processor for performing graphic functions on the gaming machine. Typically, the video memory 936 includes 1 or more frame buffers that store frame data that is sent by the video controller 937 to the display 34 or the display 42. The frame buffer is in video memory directly addressable by the video controller. The video memory and video controller may be incorporated into a video card which is connected to the processor board containing the master gaming controller 924. The frame buffer may consist of RAM, VRAM, SRAM, SDRAM, etc.

The frame data stored in the frame buffer provides pixel data (image data) specifying the pixels displayed on the display screen. In one embodiment, the video memory includes 3 frame buffers. The master gaming controller 924, according to the game code, may generate each frame in one of the frame buffers by updating the graphical components of the previous frame stored in the buffer. Thus, when only a minor change is made to the frame compared to a previous frame, only the portion of the frame that has changed from the previous frame stored in the frame buffer is updated. For example, in one position of the screen, a 2 of hearts may be substituted for a king of spades. This minimizes the amount of data that must be transferred for any given frame. The graphical component updates to one frame in the sequence of frames (e.g. a fresh card drawn in a video poker game) in the game presentation may be performed using various graphic libraries stored on the gaming machine. This approach is typically employed for the rendering of 2-D graphics. For 3-D graphics, the entire screen is typically regenerated for each frame.

Pre-recorded frames stored on the gaming machine may be displayed using video "streaming". In video streaming, a sequence of pre-recorded frames stored on the gaming machine is streamed through frame buffer on the video controller 937 to one or more of the displays. For instance, a frame corresponding to a movie stored on the game partition 928 of the hard drive 922, on a CD-ROM or some other storage device may streamed to the displays 34 and 42 as part of game presentation. Thus, the game presentation may include frames graphically rendered in real-time using the graphics libraries stored on the gaming machine as well as pre-rendered frames stored on the gaming machine 2.

When the gaming machine is in a remote operational mode and a game is presented on a display 726 of the mobile wireless game player 725, video frame data may be directly streamed from gaming machine 2 via the wireless interface 948 and wireless access point 950 to the wireless game player 725 via wireless interface 960. The video frame data may be stored in a memory 958 on the wireless game player 958 and then displayed on the display 725. The video frames sent to the wireless game player may be reduced in resolution and compressed to reduce the communication band-with necessary to transmit the video frames to the wireless game player 725.

In another embodiment, the video frames to present a game of chance may be rendered locally on the wireless game player 725. Graphical programs that allow a game to be rendered on the wireless game player may be stored in memory 958. For instance, the memory 958 may store a graphical program to render a slot game or a graphical program to render a card game. The memory 958 may store graphical programs for one or more games. For instance, the memory 958 may store graphical routines for a plurality of games supported by gaming machine 2. In one embodiment, the wireless game player 725 may be configured to allow different graphical programs for presenting different games to be downloaded into memory 958.

In other embodiments, the wireless gaming device may include a detachable memory and interface for the detachable memory. The detachable memory may store graphical applications for one or more games. Thus, to enable a particular game, a detachable memory storing graphical applications for the particular game may be inserted in the detachable memory interface on the wireless game player 725. The detachable memory may be in the form of read-only cartridges and may include a locking mechanism that prevents removal of the cartridge by the player. Thus, only authorized gaming personnel may be able to change a cartridge in the wireless game player.

The wireless game player may include a video card (not shown) to aid in the rendering process. The video card may include one or more graphical processing units that are used to render images to the display 726. The video card may be used to render 2-D graphics and 3-D graphics on the wireless game player 725. Graphical processing may also be performed by microprocessor 954 including 2-D and 3-D graphical rendering. Some images may be pre-rendered and stored on the wireless game player 725 and activated by a small string of commands from the gaming machine 2. Animations, such as reel rotation for a slot game, may be performed by routines on the wireless game player 725.

When the game graphics are rendered locally on the wireless game player 725, all of the game logic necessary to present the game of chance still resides on the gaming machine 2. Any switch or touch input necessary for game play on the wireless game player 725 (e.g., making a wager, initiating a game, holding cards, drawing cards, etc.) is transmitted 2 from the wireless game player 725 to the gaming machine 2. The gaming machine 2 executes gaming logic associated with the switch or touch inputs and sends the result back to the wireless game player 725. The wireless game player 725 verifies information sent from the gaming machine. In general, communication between the gaming machine 2 and the wireless game player 725 is encrypted. For any screen image or input involving the outcome of the game or betting, an additional level of transmit and receive data verification may be used by the wireless game player 725 and the gaming machine 2 to ensure the correct information is displayed on the wireless game player 725.

For illustrative purposes only, a series of commands between the gaming machine 2 and the wireless game player is described. The present invention is not limited to the commands described in this example. In response to input from player inputs 956 located on the wireless game player 725, the master gaming controller 924 may send a series of instructions to the wireless game player 725 that allow the game of chance to be rendered on display 726 of the wireless game player 725. The master gaming controller may also send instructions controlling audio output and other gaming devices on the wireless game player 725. For instance, for a slot game, the master gaming controller 924 may calculate symbol position, reel position, start and stop rotation for a number of reels. Then, the master gaming controller 925 may send one or more messages via the wireless communication link 952 to the wireless game player 725 with instructions such as 1) "render reels spinning", 2) "render reel 1 at position A", 3) "render reel 2 at position B", 4) "render reel 3 at position C", 5) "output audio B", 6) "display light pattern A," etc. The instructions may be processed and implemented by the microprocessor 954 using graphical software stored on the wireless game player 725.

In one embodiment, the wireless game player may be connected to a number of peripheral devices such as a printer 970 or a card reader 972. The printer 970 and the card reader 972 may communication with the wireless game player via a wire communication protocol such as serial, parallel, USB, Firewire or IEEE 1394. The peripheral devices, such as 970 and 972, may be controlled by the microprocessor 954 according to inputs received by the wireless game player and may also be controlled by the master gaming controller 924 on the gaming machine 2.

For gaming machines, an important function is the ability to store and re-display historical game play information. The game history provided by the game history information assists in settling disputes concerning the results of game play. A dispute may occur, for instance, when a player believes an award for a game outcome was not properly credited to him by the gaming machine. The dispute may arise for a number of reasons including a malfunction of the gaming machine, a power outage causing the gaming machine to reinitialize itself and a misinterpretation of the game outcome by the player. In the case of a dispute, an attendant typically arrives at the gaming machine and places the gaming machine in a game history mode. In the game history mode, important game history information about the game in dispute can be retrieved from a non-volatile storage on the gaming machine and displayed in some manner to a display on the gaming machine. The game history information is used to reconcile the dispute.

During the game presentation, the master gaming controller 924 may select and capture certain frames to provide a game history. These decisions are made in accordance with particular game code executed by controller 924. The captured frames may be incorporated into game history frames. Typically, one or more frames critical to the game presentation are captured. For instance, in a video slot game presentation, a game presentation frame displaying the final position of the reels is captured. In a video blackjack game, a frame corresponding to the initial cards of the player and dealer, frames corresponding to intermediate hands of the player and dealer and a frame corresponding to the final hands of the player and the dealer may be selected and captured as specified by the master gaming controller. Details of frame capture for game history applications are provided in U.S. Pat. No. 6,863,608, which is incorporated herein in its entirety and for all purposes.

In general, the gaming machine 2 maintains transaction logs of all events and game play. In some embodiments, as described above, the gaming machine may generate and store video frames as a game history record. The video frames may correspond to gaming information displayed on the wireless game player 725. During a wireless game play session, when the wireless game player 725 stops responding to the gaming machine 2, the game presented on the wireless game player 725 stops. The wireless game player 725 may stop responding to the gaming machine 2 because the wireless game player 725 is out-of-area reception, a battery level is low on the wireless game player, a power failure on the gaming machine 2 and other factors. To continue an interrupted game, the wireless game player 725 may ping the gaming machine 2 to reestablish communications and start the verification and authentication cycle as previously described. In the case of a dispute, the player may have to return to the gaming machine 2 so that game history records on the gaming machine can be accessed.

Figure 7:
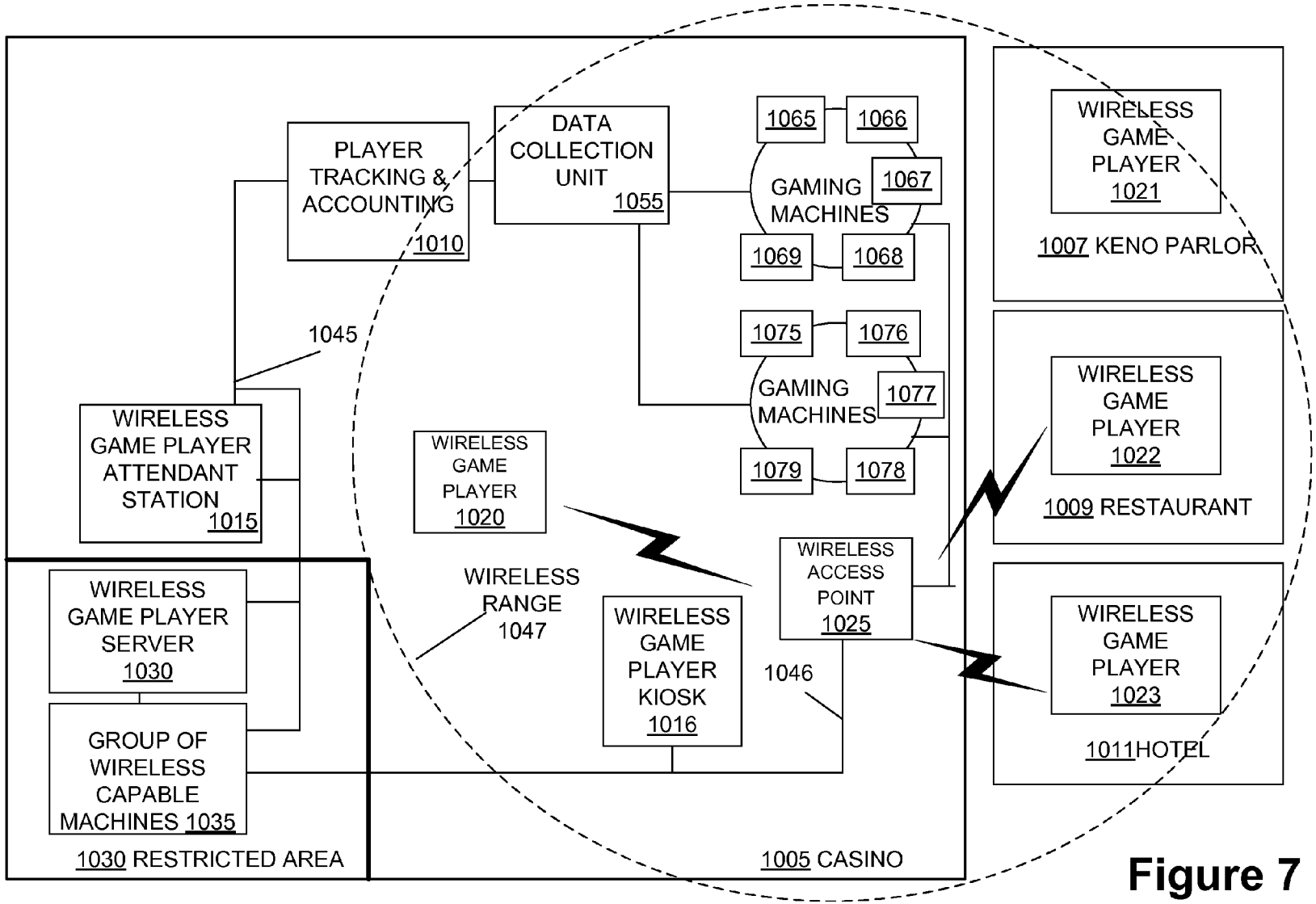
FIG. 7 is a block diagram of a network of gaming machines and wireless game players.

FIG. 7 is a block diagram of a network of gaming machines and wireless game players. Gaming machines 1065, 1066, 1067, 1068, 1069, 1075, 1076, 1077, 1078 and 1079, located in a floor area of casino 1005, support wireless game play and are connected to a wireless access point 1025. The gaming machines 1065, 1066, 1067, 1068, 1069, 1075, 1076, 1077, 1078 and 1079 are also connected to a player tracking system 1010 via a data collection unit 1055. Thus, game play on a wireless game player, such as 1020, in communication with one of the gaming machines on the casino floor may generate player tracking points. Further, a player using a game player, such as 1020, may be able to utilize services traditionally offered through player tracking devices on gaming machines such as a drink request. To provide the player tracking services, a player tracking service interface may be displayed on the touch screen of the wireless game player. Details of player tracking services and other gaming services that may be provided through a wireless game player of the present invention are described in U.S. Application No. 6,908,387, which is incorporated herein in its entirety and for all purposes.

The gaming machines located on the casino floor may also be connected to other remote servers such as but not limited to cashless system servers, progressive game servers, bonus game servers, prize servers, Internet, an entertainment content server, a concierge service server and a money transfer server and the like. Game services offered by the remote servers connected to the gaming machines may also be offered on wireless game players such as 1020. For instance, a game player may participate in a progressive game using the wireless game player 1020. In another example, a game player may be able to perform a cashless transaction enabled by a cashless system, such as the EZPAY™ cashless system (IGT, Reno Nev.), using a wireless game player.

In one embodiment, the gaming machines 1065, 1066, 1067, 1068, 1069, 1075, 1076, 1077, 1078 and 1079 connected to the access point 1025 are each provided with a wireless game player, such as 1020, 1021, 1022 and 1023. The gaming machines use a common wireless access point 1025. In this case, the access point device is also a multi-port switch. So, each machine has an Ethernet connection to the access point 1025.

In another embodiment of the present invention, an antenna may be built into a candle located on top of a gaming machine or some other location in the gaming machine. The antenna may be used as a wireless access point for wireless game play on one or more gaming machines. As an example, an antenna may be installed in the candle of gaming machine 1067 to be used as a wireless access point for wireless game play on gaming machines 1065, 1066, 1067, 1068 and 1069. A single gaming machine with an antenna may be used as part of a larger network of gaming devices providing wireless game play or may be used independently of a larger network. The antenna can, for example, be provided in accordance with the techniques described in the U.S. Pat. No. 5,605,506, entitled "CANDLE ANTENNA."

To obtain a wireless game player on one of the gaming machines on the casino floor, a player may request a wireless game player via a service call on the gaming machine such as through the player tracking system. The request may go to a remote location, such as a terminal at a wireless game player attendant station 1015 and an attendant may then bring a wireless game player to the gaming machine where the request for wireless game play has been made. The request may be routed to the attendant station 1015 via the wireless game player server 1030. When a wireless game player server 1030 is not used, the request may be sent directly to the attendant station 1015. As another example, when a request for wireless game play is made, a light on the gaming machine such as the candle on top of the gaming machine may be activated. In this case, a passing attendant may bring the game player a wireless game player. In yet another embodiment, a player may make a request for a wireless game player on a terminal at a wireless game player kiosk 1016.

Prior to enabling the network connection for the wireless game play, a person or a system program may determine the customer is eligible to use the wireless game player and verify their eligibility. For instance, most gaming jurisdictions include age eligibility rules which must be obeyed. As another example, eligibility to use a wireless game player may be based upon a player's value to a casino such as a status in a player tracking club. When authentication is required, the information is loaded from the system (could be a smart-card reader on the gaming machine) or a message appears on the gaming machine instructing the customer to provide information. For example, the gaming machines could have a fingerprint sensor located on the front panel or another biometric device. When required, the gaming machine could instruct the customer that it needs a fingerprint image or other biometric information before the customer may use the wireless game player. Information obtained through biometric sensors located on the gaming machine may be compared with information contained in a customer's biometric file. In some embodiments, the biometric information file may be downloaded to the gaming machine from a remote server and the biometric comparison may be performed on the gaming machine, the gaming machine may send biometric information to a remote server where the biometric comparison is performed, or combinations thereof.

In some instances, gaming machines supporting wireless game players may be located in a high-roller area (e.g., very valued customers) and the machines may have a specially designed stand where the wireless game players are stored. The wireless game players may be enabled by an attendant or may automatically be enabled when the casino customer inserts their player-tracking card into the gaming machine (special customer). As with the gaming machines located on the casino floor, the player-tracking system or some other remote gaming device may download the customer's biometric file to the gaming machine or the gaming machines could have a fingerprint sensor located on the front panel. When required, the gaming machine may instruct the customer that it needs a fingerprint image before the customer use the wireless game player.

To establish remote operations on the wireless game player, the gaming machine may ping the wireless game player with a series of communications. In one embodiment, once this operation is completed, the game play is transferred to the wireless game player. The screen of the gaming machines may go black (perhaps with a out-of-service message) and all customer cash and switch controls are locked out (nobody can use them). The master gaming controller on the gaming machine will continue to play the games, perform all the outcome determination and cash transaction (bets & credits), and maintains all the meter information. However, all the front panel and display data is channeled to the wireless game player. In one embodiment, when the gaming machines credit balance reaches zero, the customer is required to return to the gaming machine and insert more money. To enter more money, first, the local gaming machine controls are activated by the player or an attendant. In jurisdictions where the customer can use a debit or smart card to add money to a gaming machine, a card reader (smart card) connected to the wireless game player may be used to perform this function. In general, during a wireless game play session, the gaming machine communicates continuously with the wireless game player. In one embodiment, a web browser is used to display input switch commands. The displayed information on the wireless game player may come over from the gaming machine as HTML page information. Therefore, the wireless game player may use web-based transactions.

Additional details of a wireless game play network are described in the following paragraphs. The wireless game play network is shown in FIG. 7 is only one example of many possible embodiments of the present invention. The gaming machines and other gaming devices supporting wireless game play on wireless game players comprise a wireless game play network. The wireless game play network may be a part of a larger system network. The larger system network may provide the capability for a large number of gaming machines throughout a casino to be on the same wireless game play network. High-gain antennas and repeaters may be used to expand the range of the wireless game players allowing them to work in all areas of a casino/hotel complex, including hotels rooms and pool area. Racetracks, large bingo parlors and special outdoor events may also be covered within the wireless game play network allowing wireless game play in these areas.

The wireless game play network may also include wired access points that allow a wireless game player to be plugged directly into the network. For example, a wireless game player may include an Ethernet connector that may be directly plugged into the network segment 1046. The direct network connectors may be provided with cradles used to charge the wireless game player. The charging cradles may be located at many locations within the wireless game play network.

In FIG. 7, the range of the wireless access point 1025 is denoted by a circle 1047 used in the wireless game play network. Many such access points may be used in a wireless game play network depending upon the network topography. For instance, due the size of a particular casino and the area covered by a single access point, there could be other access points used as repeaters located throughout the casino and hotel. In addition, the wireless access point could also be connected to an existing network. After receiving an active wireless game player, a player may use the wireless game player in the areas of casino 1005 within the circle 1047. Further, the player may use the wireless game player, if approved by a local gaming jurisdiction, in the areas of a keno parlor 1007, a restaurant 1009, and a hotel 1011, which are within the circle 1047. While using the wireless game player, a player may wander to different locations within circle 1047 such as from the casino 1005 to the restaurant 1009.

In general, wireless game play in the wireless game play network is enabled by gaming devices executing licensed and regulated gaming software. However, the gaming devices supporting wireless game play are not limited gaming machines, such as 1065, 1066, 1067, 1068, 1069, 1075, 1076, 1077, 1078 and 1079 located on a casino floor. Special wireless-only gaming machines 1035 mounted in racks or containers connected to a wireless gaming network may be used to support wireless game play using wireless game players. The wireless-only gaming machines 1035 may not offer local game play. For instance, the wireless-only gaming machines 1035 may not include display screens. However, the wireless-only gaming machines are still regulated and licensed in a manner similar to traditional gaming machines. As another example, a wireless game player server 1030 with multiple processors may be used to support simultaneous game play on a plurality of wireless game players. The wireless-only gaming machines 1035 and the wireless game play server 1030 may be located in a restricted area 1030 of the casino 1005 and may not be generally accessible to game players.

The wireless-only gaming machines 1035 and wireless game play server 1030 are connected the wireless access point 1025 via a connection 1046. The wireless-only gaming machines 1035 and wireless game play server are also in communication with a wireless game player attendant station 1015 and the player tracking and accounting server 1010 via network connection 1045. The wireless-only gaming machine and wireless game player server 1030 may also be connected to other remote gaming devices such as a progressive servers, cashless system servers, bonus servers, prize servers and the like.

When using a wireless-only gaming machine, the customer may use a kiosk, such as 1016 or a cashier to enter cash and provide authentication information for a wireless game play session using a wireless game player. Then, the customer may be assigned a wireless game player, such as 1020, 1021, 1022 and 1023, in communication with one of the wireless-only gaming machines 1035 or the wireless game play server 1030. Once authenticated and verified, the customer may select a game and begin playing the wireless game player. There may be wireless game play cradles in the keno parlor 1022, restaurant 1009 or Sports Book areas, allowing the customer to play their favorite casino machine game and at the same time make keno or Sports Book bets or eat. In addition, the wireless game play cradles may be used to charge batteries on the wireless game player and may also be used to provide an additional network access point such as through a wire connection provided on the cradle. The wireless game player may also be used for Sports Book and Keno betting. Thus, a player may watch a horserace or see the results of a certain event on the display of the wireless game player.

Finally, the wireless game player may also be used for other activities besides gaming. For example, because of the authentication and verification (security) features, the wireless game player could be safe way to conduct monetary transactions such as electronic funds transfers. As another example, the wireless game player may be used for video teleconferencing to visually connect to a casino host or to provide instant messaging services. In addition, when the wireless game player supports web-based browsers and the wireless game play network includes Internet access, the wireless game player may be used to obtain any web-based services available over the Internet.

Figure 8:
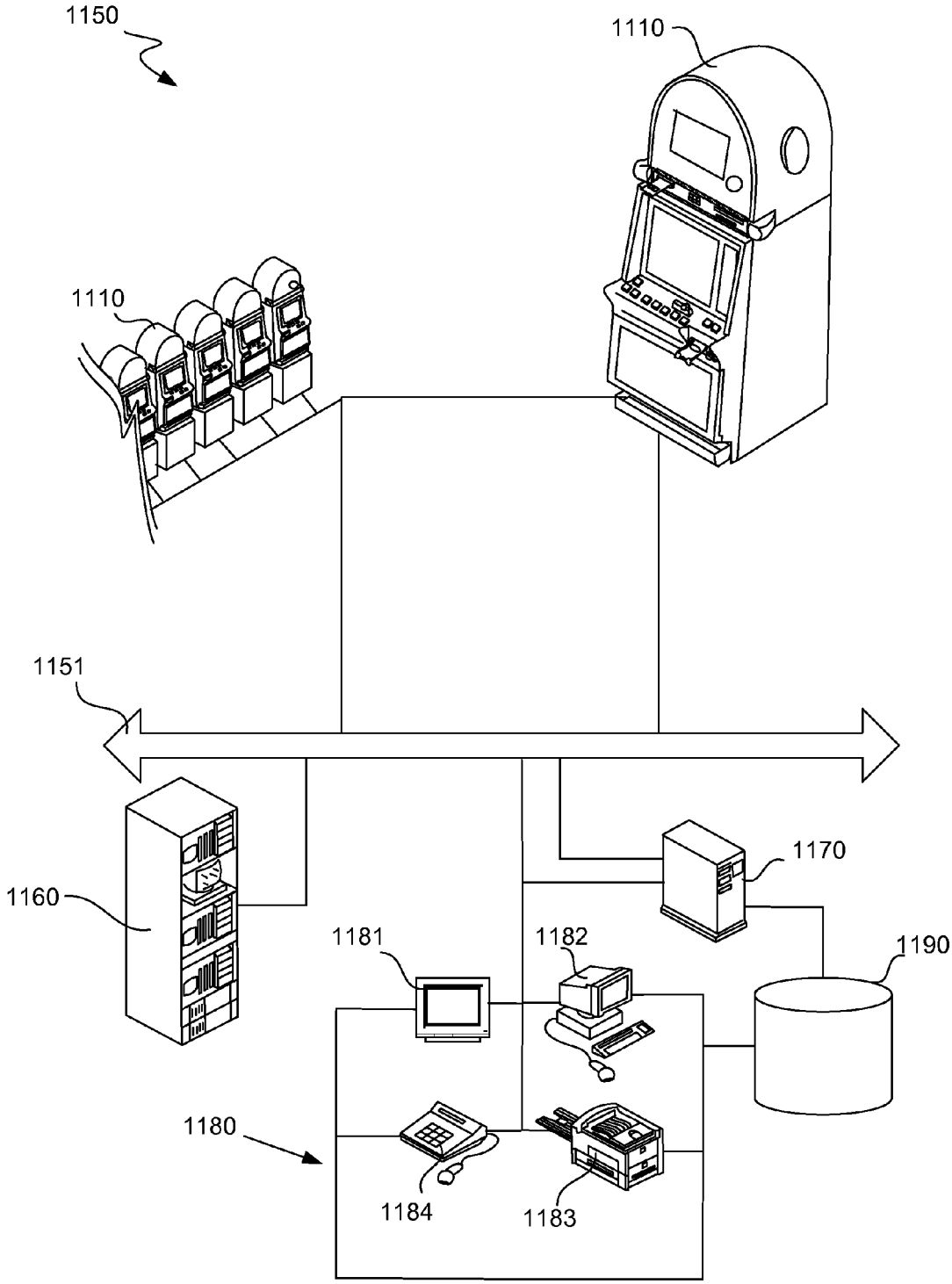
FIG. 8 illustrates in block diagram format an exemplary network infrastructure.

Referring now to FIG. 8, an exemplary network infrastructure for providing a gaming system having one or more gaming machines is illustrated in block diagram format. Exemplary gaming system 1150 has one or more gaming machines, various communication items, and a number of host-side components and devices adapted for use within a gaming environment. As shown, one or more gaming machines 1110 adapted for use in gaming system 1150 can be in a plurality of locations, such as in banks on a casino floor or standing alone at a smaller non-gaming establishment, as desired. Common bus 1151 can connect one or more gaming machines or devices to a number of networked devices on the gaming system 1150, such as, for example, a general-purpose server 1160, one or more special-purpose servers 1170, a sub-network of peripheral devices 1180, and/or a database 1190.

A general-purpose server 1160 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 1150 contains one or more special-purpose servers that can be used for various functions relating to the provision of cashless gaming and gaming machine administration and operation under the present methods and systems. Such a special-purpose server or servers could include, for example, a cashless gaming server, a player verification server, a general game server, a downloadable games server, a specialized accounting server, and/or a visual image or video distribution server, among others. Of course, these functions may all be combined onto a single specialized server. Such additional special-purpose servers are desirable for a variety of reasons, such as, for example, to lessen the burden on an existing general-purpose server or to isolate or wall off some or all gaming machine administration and operations data and functions from the general-purpose server and thereby increase security and limit the possible modes of access to such operations and information.

Alternatively, exemplary gaming system 1150 can be isolated from any other network at the establishment, such that a general-purpose server 1160 is essentially impractical and unnecessary. Under either embodiment of an isolated or shared network, one or more of the special-purpose servers are preferably connected to sub-network 1180, which might be, for example, a cashier station or terminal. Peripheral devices in this sub-network may include, for example, one or more video displays 1181, one or more user terminals 1182, one or more printers 1183, and one or more other input devices 1184, such as a ticket validator or other security identifier, among others. Similarly, under either embodiment of an isolated or shared network, at least the specialized server 1170 or another similar component within a general-purpose server 1160 also preferably includes a connection to a database or other suitable storage medium 1190. Database 1190 is preferably adapted to store many or all files containing pertinent data or information regarding cashless instruments such as tickets, among other potential items. Files, data and other information on database 1190 can be stored for backup purposes, and are preferably accessible at one or more system locations, such as at a general-purpose server 1160, a special purpose server 1170 and/or a cashier station or other sub-network location 1180, as desired.

While gaming system 1150 can be a system that is specially designed and created new for use in a casino or gaming establishment, it is also possible that many items in this system can be taken or adopted from an existing gaming system. For example, gaming system 1150 could represent an existing cashless gaming system to which one or more of the inventive components or program modules are added. In addition to new hardware, new functionality via new software, modules, updates or otherwise can be provided to an existing database 1190, specialized server 1170 and/or general-purpose server 1160, as desired. In this manner, the methods and systems of the present invention may be practiced at reduced costs by gaming operators that already have existing gaming systems, such as an existing EZ Pay® or other cashless gaming system, by simply modifying the existing system. Other modifications to an existing system may also be necessary, as might be readily appreciated.

The various aspects, features, embodiments or implementations of the invention described above can be used alone or in various combinations.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A computing system for allowing two or more entities to participate as partners in one or more games provided in a gaming environment, wherein said computing system is configured to:

receive a partnership identifier in connection with at least one game of a number of different types of games to be played on behalf of a partnership of said two or more entities, wherein said partnership identifier identifies said partnership of said two or more entities, and wherein said at least one game has an outcome that can be determined when said at least one game is played on behalf of said partnership of said two or more entities;

receive partnership data associated with said partnership;

determine whether to authorize playing of said at least one game on behalf of said partnership based, at least in part, on: (a) said partnership data, and (b) whether said at least one game is a type of game that qualifies for play on behalf of said partnership;

authorize said at least one game to be played on behalf of said partnership when it is determined that said at least one game qualifies for play on behalf of said partnership by a partnership member;

track said at least one game if said at least one game qualifies for play on behalf of said partnership;

obtain at least verification data for verification of said outcome of said at least one game after receiving said partnership identifier, wherein said verification data can be used to verify said outcome of said at least one game when said at least one game is played on behalf of said partnership;

store said verification data for subsequent verification of said outcome, thereby allowing said two or more entities to verify the outcome of said at least one game played on behalf of said partnership of said two or more entities; and change the type of game that qualifies for play on behalf of said partnership by a partnership member.

2. The computing system of claim 1, wherein said computing system is further configured to play said at least one game on behalf of said partnership of said two or more entities.

3. The computing system of claim 1, wherein said computing system is further configured to determine the outcome of said at least one game when said at least one game is played on behalf of said partnership of said two or more entities.

4. The computing system of claim 1, wherein said partnership data includes partnership rules data effectively defining the rules for said partnership.

5. The computing system of claim 1, wherein said computing system generates said verification data for verification of said outcome of said at least one game when said at least one game is played on behalf of said partnership.

6. The computing system of claim 1, wherein said computing system is further configured to: determine whether to update said partnership data associated with said partnership as a result of playing said at least one game on behalf of said partnership.

7. The computing system of claim 1, wherein tracking said at least one game comprises one or more of the following:

storing data representative of the outcome of said at least one game;

storing simulation data representative of the outcome of said at least one game, wherein said simulation data can be used to effectively simulate game play or a game result associated with said at least one game; and recording at least a portion of said at least one game when said at least one game is played on behalf of said partnership.

8. The computing system of claim 7, wherein said recording comprises one or more of the following:

storing the displayed result of said at least one game; and storing a displayed portion or screen of said at least one game.

9. The computing system of claim 1, wherein said computing system is a gaming machine or a server that can effectively provide said at least one game to be played on behalf of said partnership.

10. The computing system of claim 1, wherein said at least one game is one or more of the following:

a general game category, a specific game, a particular instance of a particular game, a table game, a video game, and a slot game.

11. The computing system of claim 1, wherein said verification data is stored in a local or remote database accessible by said computing system.

12. The computing system of claim 1, wherein said at least one game is a progressive game.

13. The computing system of claim 1, wherein said at least one game is a Wide Area Progressive (WAP) game.

14. A method for allowing two or more entities to participate as partners in one or more games provided in a gaming environment, said method comprising:

receiving at a computing system a partnership identifier in connection with at least one game of a number of different types of games to be played on behalf of a partnership of said two or more entities, wherein said partnership identifier identifies said partnership of said two or more entities, and wherein said at least one game has an outcome that can be determined when said at least one game is played on behalf of said partnership of said two or more entities;

receiving by the computing system partnership data associated with said partnership;

determining by the computer system whether to authorize playing of said at least one game on behalf of said partnership based, at least in part, on: (a) said partnership data, and (b) whether said at least one game is a type of game that qualifies for play on behalf of said partnership;

authorizing by the computer system said at least one game to be played on behalf of said partnership when it is determined that said at least one game qualifies for play on behalf of said partnership by a partnership member;

tracking said at least one game if said at least one game qualifies for play on behalf of said partnership;

obtaining by the computing system at least verification data for verification of said outcome of said at least one game after receiving said partnership identifier, wherein said verification data can be used to verify said outcome of said at least one game when said at least one game is played on behalf of said partnership;

storing by the computing system said verification data for subsequent verification of said outcome, thereby allowing said two or more entities to verify the outcome of said at least one game played on behalf of said partnership; and changing the type of game that qualifies for play on behalf of said partnership by a partnership member.

15. The method as recited in claim 14, wherein said method further comprises:

playing said at least one game on behalf of said partnership of said two or more entities.

16. The method of claim 14, wherein said method further comprises:

determining the outcome of said at least one game when said at least one game is played on behalf of said partnership of said two or more entities.

17. The method of claim 14, wherein said partnership data includes partnership rules data effectively defining the rules for the partnership.

18. The method of claim 14, wherein said method further comprises:

generating said verification data for verification of said outcome of said at least one game when said at least one game is played on behalf of said partnership.

19. The method of claim 14, wherein said method further comprises:

determining whether to update said partnership data associated with said partnership as a result of playing said at least one game on behalf of said partnership.

20. The method of claim 14, wherein said tracking of said at least one game comprises one or more of the following:

storing data representative of the outcome of said at least one game;

storing simulation data representative of the outcome of said at least one game, wherein said simulation data can be used to effectively simulate game play or a game result associated with said at least one game when said at least one game is played on behalf of said partnership; and recording said at least one game as it is played.

21. A non-transitory computer readable medium including at least computer program code for allowing two or more entities to participate as partners in one or more games provided in a gaming environment, wherein said computer readable medium comprises:

computer program code for receiving a partnership identifier in connection with at least one game of a number of different types of games to be played on behalf of a partnership of said two or more entities, wherein said partnership identifier identifies said partnership of said two or more entities, and wherein said at least one game has an outcome that can be determined when said at least one game is played on behalf of said partnership of said two or more entities;

computer program code for receiving partnership data associated with said partnership;

computer program code for determining whether to authorize playing of said at least one game on behalf of said partnership based, at least in part, on: (a) said partnership data, and (b) whether said at least one game is a type of game that qualifies for play on behalf of said partnership;

computer program code for authorizing said at least one game to be played on behalf of said partnership when it is determined that said at least one game qualifies for play on behalf of said partnership by a partnership member;

computer program code for tracking said at least one game if said at least one game qualifies for play on behalf of said partnership;

computer program code for obtaining at least verification data for verification of said outcome of said at least one game after receiving said partnership identifier, wherein said verification data can be used to verify said outcome of said at least one game when said at least one game is played on behalf of said partnership;

computer program code for storing said verification data for subsequent verification of said outcome, thereby allowing said two or more entities to verify the outcome of said at least one game played on behalf of said partnership; and computer program code for changing the type of game that qualifies for play on behalf of said partnership by a partnership member.

22. A computing system for forming a partnership of two or more entities for the purpose of allowing one or more games to be played on behalf of said partnership in a gaming environment, wherein said computing system is configured to:

receive partnership information associated with said two or more entities that wish to participate as partners in said one or more games provided by said gaming environment;

determine a partnership identifier that identifies said partnership for the purpose of participation of said two or more entities as partners in said one or more games provided by said gaming environment;

store said partnership identifier for said partnership, thereby allowing said two or more entities to participate in said one or more games as partners when said partnership identifier is presented in connection with said one or more games to be played on behalf of said partnership;

generate, based on said partnership information, partnership data that defines said partnership of said two or more entities for the purpose of participation of said two or more entities as partners in said one or more games;

store said partnership data for said partnership, wherein said partnership data includes partnership rules data that can be used to authorize playing of at least one game of a number of different types of games on behalf of said partnership by a partnership member when it is determined that said at least one game qualifies for play on behalf of said partnership based, at least in part, on whether said at least one game is a type of game that qualifies for play on behalf of said partnership; and change the type of game that qualifies for play on behalf of said partnership by a partnership member.

23. The computing system of claim 22, wherein said partnership data further defines one or more of the following:

one or more types of games to be played on behalf of said partnership;

one or more gaming entities or establishments where said one or more games are authorized to be played on behalf of said partnership;

one or more gaming entities or establishments where said one or more games are not authorized to be played on behalf of said partnership;

an amount of funds or credit available for play on behalf of said partnership;

information regarding one or more of said entities;

personal information regarding two or more individuals that have formed said partnership;

an amount of individual contribution of said two or more entities;

an amount of individual distribution to said two or more entities;

rules regarding termination of said partnership for one or more of said two or more entities;

rules regarding allowing entities to join said partnership; and one or more players that can play said at least one game on behalf of said partnership.

24. The computing system of claim 22, wherein said computing system is further configured to:

receive a request to form said partnership, wherein said request can be effectively submitted by at least one person who wishes to form said partnership.

25. The computing system of claim 22, wherein said two or more entities include one or more of the following:

one or more persons;

a group of persons;

one or more organizations;

a group of organizations;

one or more players; and a group of players.

26. The computing system of claim 24, wherein said computing system is further configured to:

output said partnership identifier or another identifier that effectively identifies said partnership in response to said request to form said partnership.

27. The computing system of claim 26, wherein said output of said partnership identifier or another identifier comprises one or more of the following:

issuing an instrument that encodes said partnership identifier or another identifier that effectively identifies said partnership;

issuing an instrument that prints said partnership identifier or another identifier that effectively identifies said partnership;

issuing a player tracking card;

updating a player tracking card;

issuing a coupon or voucher;

updating a coupon or voucher;

issuing or updating a card or ticket;

displaying said partnership identifier or another identifier that effectively identifies said partnership; and electronically transmitting said partnership identifier or another identifier that effectively identifies said partnership.

28. A method for forming a partnership of two or more entities for the purpose of allowing one or more games to be played on behalf of said partnership of said two or more entities, said method comprising:

receiving at a computing system partnership information associated with said two or more entities that wish to participate as partners in said one or more games effectively provided by a gaming environment;

determining by the computing system a partnership identifier that effectively identifies said partnership for the purpose of participation of said two or more entities as partners in said one or more games provided by said gaming environment;

storing by the computing system said partnership identifier for said partnership, thereby allowing said two or more entities to participate in said one or more games as partners when said partnership identifier is effectively presented in connection with said one or more games to be played on behalf of said partnership;

generating by the computer system, based on said partnership information, partnership data that defines said partnership of said two or more entities for the purpose of participation of said two or more entities as partners in said one or more games;

storing said partnership data for said partnership, wherein said partnership data includes partnership rules data that can be used to authorize playing of at least one game of a number of different types of games on behalf of said partnership by a partnership member when it is determined that said at least one game qualifies for play on behalf of said partnership based, at least in part, on whether said at least one game is a type of game that qualifies for play on behalf of said partnership; and changing the type of game that qualifies for play on behalf of said partnership by a partnership member.

29. A non-transitory computer readable medium including at least computer program code for forming a partnership of two or more entities for the purpose of allowing one or more games to be played on behalf of said partnership of said two or more entities in a gaming environment, said computer readable medium comprising:

computer program code for identifying partnership information associated with said two or more entities that wish to participate as partners in said one or more games effectively provided by said gaming environment;

computer program code for determining a partnership identifier that effectively identifies said partnership for the purpose of participation of said two or more entities as partners in said one or more games provided by said gaming environment;

computer program code for storing said partnership identifier for said partnership, thereby allowing said two or more entities to participate in said one or more games as partners when said partnership identifier is effectively presented in connection with said one or more games to be played on behalf of said partnership;

computer program code for generating, based on said partnership information, partnership data that effectively defines said partnership of said two or more entities for the purpose of participation of said two or more entities as partners in said one or more games;

computer program code for storing said partnership data for said partnership, wherein said partnership data includes partnership rules data that can be used to authorize playing of at least one game of a number of different types of games on behalf of said partnership by a partnership member when it is determined that said at least one game qualifies for play on behalf of said partnership based, at least in part, on whether said at least one game is a type of game that qualifies for play on behalf of said partnership; and computer program code for changing the type of game that qualifies for play on behalf of said partnership by a partnership member.

* * * * *